US005828337A

United States Patent [19]

Aoshima et al.

[11] Patent Number: 5,828,337

[45] Date of Patent: Oct. 27, 1998

[54] VEHICLE-MOUNTED SATELLITE SIGNAL RECEIVING APPARATUS

[75] Inventors: Shigeki Aoshima, Susono; Tomohisa Harada, Aichi-ken, both of Japan

[73] Assignee: Toyota Jidosha Kabushiki Kaisha, Toyota, Japan

[21] Appl. No.: 861,851

[22] Filed: May 22, 1997

[30] Foreign Application Priority Data

May 24, 1996 [JP] Japan ..... 8-130133

[51] Int. Cl.[6] ..... H01Q 3/00

[52] U.S. Cl. ..... 342/359

[58] Field of Search ..... 342/359

[56] References Cited

U.S. PATENT DOCUMENTS

| | | | |
|---|---|---|---|
| 5,227,806 | 7/1993 | Eguchi | 343/765 |
| 5,347,286 | 9/1994 | Babitch | 342/359 |
| 5,594,460 | 1/1997 | Eguchi | 343/765 |

FOREIGN PATENT DOCUMENTS

| | | |
|---|---|---|
| 63-262904 | 10/1988 | Japan . |
| 4-174385 | 6/1992 | Japan . |
| 4-232483 | 8/1992 | Japan . |
| 4-336821 | 11/1992 | Japan . |
| 5-142321 | 6/1993 | Japan . |

*Primary Examiner*—Theodore M. Blum
*Attorney, Agent, or Firm*—Cushman Darby & Cushman IP Group of Pillsbury Madison & Sutro LLP

[57] ABSTRACT

In a vehicle mounted satellite signal receiving apparatus which adopts a satellite tracking system combining a gyro tracking with a hybrid tracking, there is provided a device which can revise an offset error correction value of a gyro sensor, even if there is a drift in the offset error. In this device, gyro tracking is performed when a reception level is a threshold value $L_C$ or more. The gyro tracking is performed by setting an antenna at an angular velocity ω, which is derived from an equation, $\omega = -\omega G + \Delta\omega G$, where $-\omega G$ is a value resulted from conversion of sign for gyro angular velocity ωG, and ΔωG is a prescribed offset error correction value. A reception level declines if the offset error correction value ΔωG deviates and therefore an apparent offset error arises in the gyro sensor. When the reception level declines below a threshold value $L_B$, the aforementioned offset error correction value ΔωG is revised, basing on the direction of an angular velocity ωS which is used in the hybrid tracking (or step tracking).

16 Claims, 12 Drawing Sheets

ΔωG : OFFSET ERROR
ωS : ANGULAR VELOCITY OF STEP TRACK

NOTE: VARIATION OF STATIC TIME OUTPUTS AT THE TIME OF APPLYING TEMPERATURE IS MEASURED. BY USING THE TEMPERATURE PATTERN SHOWN IN THE DRAWING, AMBIENT TEMPERATURE IS VARIED. THIS FEATURE VARIES DEPENDING ON EACH MANUFACTURED GOOD.

NOTE: STATIC TIME OUTPUTS DURING A PERIOD OF ONE SECOND TO TEN MINUTES AFTER ENERGIZING ARE MEASURED. THIS FEATURE VARIES DEPENDING ON EACH MANUFACTURED GOOD.

VEHICLE-MOUNTED SATELLITE SIGNAL RECEIVING APPARATUS

BACKGROUND OF THE INVENTION

1. Field of the Invention

The present invention relates to a satellite signal receiving apparatus to be mounted on vehicles. This apparatus has a function to correct offset errors, especially as many arise in output signals of a gyro sensor for satellite tracking, and to revise correction values used for the correction in order to cope with such drifts.

2. Description of the Related Art

Heretofore, there has been developed an apparatus to be mounted on vehicles such as automobiles, for receiving electromagnetic signals by tracking a broadcasting satellite (hereinafter referred to as BS) so that a receiving antenna will point to the broadcasting satellite all the time. More specifically, at the time of commencement of reception, the receiving antenna is rotated so as to search a position at which a level of receiving radio waves from the BS are maximized. For the purpose of maintaining the reception level, sampling of the reception level is executed by changing an angle of the receiving antenna very slightly and the optimum position is then detected basing on the change of the level at that time (step tracking system).

However, the aforementioned system cannot be used when the vehicle's motion makes it impossible to track a BS signal. Under the circumstances, it is proposed to provide a device for tracking the BS basing on an azimuth of the vehicle which is detected by an installed azimuth sensor, such as a gyro sensor.

Japanese Patent Laid-Open Publication No. Hei 4-336821 discloses a satellite broadcasting receiving apparatus to be mounted on vehicles. In a weak electric field, this apparatus performs tracking in such a manner that the antenna points to the satellite by means of a gyro sensor. In a strong electric field, on the other hand, it performs tracking in such a manner that the antenna points to the satellite by the utilization of a crest value.

Further, Japanese Patent Laid-Open Publication No. Sho 63-262904 teaches a satellite broadcasting receiving apparatus to be mounted on vehicles.

Japanese Patent Laid-Open Publication No. Hei 5-142321 discloses a satellite broadcasting receiving apparatus to be mounted on vehicles capable of calibrating an angle sensor. This apparatus can control an antenna to point to a satellite using an inexpensive angle sensor, even when radio waves are cut off.

However, when tracking of a broadcasting satellite is performed using a sensor such as a gyro sensor, it will be difficult to perform accurate tracking of a broadcasting satellite when a temperature drift or the like is given to an offset error arising in output signals of the gyro sensor due to changes while standing or a temperature change which may occur while the vehicle is in motion. This causes a problem that satellite broadcasting cannot be received. More specifically, if any drift, such as a temperature drift or a time drift, is given to an offset error which has arisen in an output signal of the gyro sensor, a value (zero) of the output signal will change when a yaw rate is zero degrees per second. A state of drift given to the offset error arose in the output signal of the gyro sensor is shown in FIGS. 10 and 11.

FIG. 10 shows a graph concerning the outcome of actual measurement of a temperature drift of the gyro sensor. In this graph, the abscissa represents time, whereas the ordinate shows output voltage or temperature of the gyro sensor. This graph shows the variation of output voltage of three gyro sensors in a case where the temperature is raised from +25° C. to +80° C. and then lowered to −30° C.

In the same manner as that of FIG. 10, FIG. 11 shows a graph concerning the outcome of actual measurement of a time drift of the gyro sensor. In this graph, an axis of abscissa represents time, whereas an axis of ordinate represents output voltage of the gyro sensor. As shown in this graph, with the lapse of time, output voltage of the gyro sensor changes, although the gyro sensor is maintained in a static condition. In other words, the value of the offset error changes. This graph also shows respective time drifts of three gyro sensors in the same manner as that of FIG. 10.

As discussed above, an offset error of the gyro sensor varies by time and temperature. Even though the offset error is completely corrected in the beginning, the value of the offset error will change as time goes by and the correction value of the offset error becomes inaccurate. Consequently, even though the vehicle is in a static condition, it will be mistaken that the vehicle is making a right-handed or left-handed circular movement. There is a possibility of tracking failure, especially at the time of circular movement of vehicle. Further, as the quality of manufactured vibrating gyro sensors may vary widely, output voltage may change with time or temperature.

How the tracking ends in failure when the offset error of the gyro sensor arises will be subsequently described by reference to FIG. 13. For example, it is assumed that an antenna points to a BS at a point C and satellite broadcasting is being received in FIG. 13 (A). If a vehicle moves from the point C to a point D, a gyro sensor mounted on the vehicle will detect a yaw rate of the vehicle. However, if an offset $\Delta x$ shown in FIG. 13 (B) arises in the gyro sensor, an error shown in FIG. 13 (C) will arise in a yaw angle of the vehicle due to the offset $\Delta x$. As a result, it is unable to control the antenna to point to the BS at the point D as shown in FIG. 13 (A).

As a matter of course, a very accurate gyro sensor, which is unnecessary to take account of such a temperature drift and an offset error, has been developed. However, such sensors are very expensive and it not suitable for being mounted on vehicles.

The present invention is made in light of the problems of the aforementioned prior art. The object of the present invention is to provide a satellite signal receiving apparatus to be mounted on vehicles which is capable of performing a secure tracking by swiftly and easily correcting a temperature drift or a time drift given to an offset error in the gyro sensor.

SUMMARY OF THE INVENTION

As will be described hereafter, a vehicle mounted satellite signal receiving apparatus according to the present invention performs tracking using a gyro sensor in the case of a strong reception level. However, if the reception level is weak, the apparatus adopts a tracking system which carries out a step tracking. In a preferred embodiment which will be described later, instead of step tracking hybrid tracking, which is a combination of step tracking and gyro tracking, is used.

A first aspect of the present invention is made in order to solve the aforementioned problems. This invention is a satellite signal receiving apparatus to be mounted on vehicles comprising:

an antenna mounted on a vehicle;

a gyro sensor for detecting an angular velocity of azimuth rotation of the vehicle;

offset error correcting means for adding a correction value used to correct an offset error of an output signal of the aforementioned gyro sensor to the output signal of the gyro sensor and for outputting a corrected output signal of the gyro sensor which results from the correction of the aforementioned offset error;

gyro tracking means for controlling directions of the aforementioned antenna based on the aforementioned corrected output signal of the gyro sensor when a level of a received a satellite signal is a prescribed value or more; and step tracking means for controlling directions of the aforementioned antenna in order to raise a level of a received satellite signal when the level is below a prescribed value.

The satellite signal receiving apparatus according to the present invention further comprises:

revising means for revising the correction value used to correct the aforementioned offset error by adding quantity of revision in a same direction as a direction controlled by the aforementioned step tracking means to the aforementioned correction value when the aforementioned level of receiving satellite signal falls below the aforementioned prescribed value and the aforementioned step tracking means commences controlling.

A drift which arises in an offset error of the gyro sensor is considered to be one of the reasons for shifting to step tracking from gyro tracking when reception level decreases. Due to a time drift or a temperature drift which arises in an offset error, it is difficult to detect the antenna rotating speed, thereby leading to false control. Further, the direction of the antenna gradually deviates from the direction of a satellite, and therefore the reception level falls below a prescribed value. As a step tracking after the reception level is lowered functions to revise the directional deviation of the gyro sensor after the reception level is lowered, a direction already controlled by step tracking coincides with a direction after revising the drift which arose in the offset error of a gyro sensor signal. The present invention enables accurate correction of the offset error by adding quantity of revision in the same direction as the direction controlled by step tracking to the offset error correction value of the gyro sensor.

It is not necessary for the revising means, one of the features of the present invention, to begin revision immediately after the step tracking means is activated, and it is preferable for the revising means to make a revision at a time of shifting back to gyro tracking. In the case of this revising means of the present invention, it is sufficient to revise the correction value at any time during a series of processes which start from gyro tracking and shift to step tracking and then return to gyro tracking. However, it is preferable to carry out the revision when step tracking is shifted to gyro tracking.

As described above, in the satellite signal receiving apparatus which is capable of switching gyro tracking and step tracking as the occasion may demand, an offset error correction value of a gyro sensor used for gyro tracking is adjusted to the direction controlled by step tracking. Therefore, even though a time drift or a temperature drift arises in the offset error, the drift can be removed, whereby an accurate correction of the offset error can be performed at all times. In the present invention, the term "step tracking" is used as a matter of convenience. However, it is obvious the present invention will be applicable to any tracking system which includes step tracking. For example, in a preferred embodiment which will be described later, an example of hybrid tracking, which is a combination of step tracking and gyro tracking, is shown instead of step tracking.

In order to solve the problems described above, in a second aspect of the present invention, which is based on the vehicle mounted satellite signal receiving apparatus according to the first aspect of the present invention, the aforementioned revising means adds the aforementioned quantity of revision to the aforementioned correction value only when a prescribed time period is equal to or shorter than a time period during which the aforementioned reception level is a second prescribed value or more.

In a vehicle mounted satellite signal receiving apparatus, there is a case that the reception level temporarily falls below a prescribed value due to an obstruction such as a tree or the like. As in such a case the reason why the reception level falls below a prescribed value is not an offset error, it is not appropriate to revise the correction value of the offset error. Therefore, this aspect is constituted in such a manner that, if the reception level falls below a second prescribed value for only a very short period of time due to obstruction by a tree or the like, revision of the correction value of the offset error according to the first aspect will not be carried out. Here, the second prescribed value is smaller than the prescribed value of the first aspect.

As described above, the invention of the second aspect does not make an inappropriate revision, whereby the correction value of the offset error can be accurately revised.

In order to solve the problems described above, the third aspect of the present invention, a vehicle mounted satellite signal receiving apparatus on vehicles according to the first aspect described above, includes rolling/pitching detecting means for detecting vehicle rolling or pitching. Further, the aforementioned revising means adds the aforementioned quantity of revision to the aforementioned correction value only in such a case that the aforementioned rolling/pitching detecting means has not detected rolling or pitching of a vehicle.

As described above, in the first aspect, when the reception level falls below the prescribed value and the gyro tracking shifts to step tracking, the correction value of the offset error is revised because the decline of the reception level up to below the prescribed value is considered to be due to an offset error. In other words, the direction of an antenna deviates from that of a satellite due to an offset error or an incomplete correction of the offset error. As a result, when the reception level falls below the prescribed value, the correction value of the offset error is revised basing on quantity of control performed by the step tracking.

However, besides such an offset error and incomplete correction of the offset error, there are some other reasons for a decline of the reception level to below the prescribed value. For example, in the second aspect, once a reception level falls below a prescribed value during the past prescribed period of time, no further revision of the correction value of the offset error will be performed in order to avoid excessive repetition of the revision in cases where a reception level falls while the vehicle is in motion due to some obstruction.

Further, generally speaking, a vehicle is moving circular. Therefore, antenna direction deviates from that of a satellite due to inclination of the vehicle's body to the right or left. This occasionally causes a decline in reception level.

It is preferable not to make a revision to correct the offset error in a case where the reception level falls due to inclination of the body. The third aspect of the present invention, which includes rolling/pitching detecting means, is so constituted that as long as the yaw rate of a vehicle is a certain value or more, revision of the offset error correction value will not be performed, even when the reception level falls below a prescribed value.

Due to such a constitution, the offset error correction value can be accurately revised even when the body inclines.

In order to solve the problems described above, in the fourth aspect of the present invention which is a vehicle mounted satellite signal receiving apparatus according to the first or second aspects, the aforementioned revising means adds the aforementioned quantity of revision to the aforementioned correction value only in cases when a level declining velocity at the time the reception level falls below the prescribed value and is equal to or lower than a prescribed velocity.

As shown in the description of the second and third aspects, in the case of a decline of the reception level resulting from incomplete correction of the offset error, the correction value of the offset error should be revised. However, such revision should not be performed when a decline of reception level results from other factors.

In order to distinguish the case of incomplete correction of the offset error from the other cases, a time period and a yaw rate are detected in the second and third aspects. In this method, a specified reason for a decline of the reception level can be distinguished, but any cases other than the case of incomplete correction of the offset error can not be distinguished in the gross.

On the other hand, a decline of the reception level resulting from an incomplete correction value of the offset error is usually observed as a gentle decline of the reception level. Then, the fourth aspect of the present invention, the slope (i.e. a declining velocity of the reception level) of a decline of the reception level is detected. If the slope is below a prescribed value, it will be determined that the reception level has fallen due to incomplete correction of the offset error. If the slope is equal to or greater than the prescribed value, it will be determined that the reception level falls due to a factor other than the incomplete correction of the offset error, and it is therefore decided not to revise the correction value of the offset error.

With this constitution, the correction value of the offset error can be more accurately revised by the gyro sensor.

In order to solve the problems described above, fifth and sixth aspects of the present invention, include initial offset error correction incomplete state detecting means for detecting a state in which the correction of a drift has not been completed after power was supplied. Further, the aforementioned revising means will operate to add the aforementioned quantity of revision to the aforementioned correction value, as long as the aforementioned initial offset error correction incomplete state detecting means is detecting a state of incomplete correction of an offset error after supplying power, even though (1) a prescribed time period is equal to or shorter than a time period during which the aforementioned reception level is the aforementioned second prescribed value or more, (2) the aforementioned rolling or pitching is detected, or (3) the aforementioned level declining velocity at the time the reception level falls below the aforementioned prescribed value is higher than the prescribed velocity.

The second, third, and fourth aspects of the present invention are constituted so that the offset error correction value is not revised as long as each prescribed condition is satisfied. Generally speaking, however, an extremely large error will arise immediately after power is supplied if correction of the initial offset error has not been completed. It is generally expected that if the correction of the offset error is revised, the correction value will more quickly converge. Therefore, in the fifth aspect of the present invention, if the initial offset error has not been completely corrected by means according to the second, third, or fourth aspect, the correction value of the offset error will be revised.

By such a method, it is possible for the offset error correction value to quickly converged.

In order to solve the problems described above, in a sixth aspect of the present invention, the aforementioned initial offset error correction incomplete state detecting means makes determination basing on the rate of change of a satellite signal reception level. More specifically, if the rate of change is greater than or equal to a prescribed value, it will be determined that the initial offset error has not been corrected. If the rate of change is below the prescribed value, it will be determined that the initial offset error has been corrected.

In the fifth aspect described above, in order to achieve prompt convergence of the offset error correction value, a determination is made of whether or not the correction of the initial offset error is in progress. Under the circumstances, the initial offset error correction incomplete state detecting means of the sixth aspect of present invention will determine that the initial offset error has not been corrected yet (a state of incomplete correction of an offset error), if the rate of level change of the satellite signal is greater than or equal to the prescribed value. Therefore, it is possible to accurately detect that such an initial offset error has not been completely corrected.

In order to solve the problems described above, in a seventh aspect of present invention, the aforementioned revising means includes deciding means for deciding a value of the aforementioned quantity of revision of the aforementioned offset error correction value based on the degree the offset error correction value converges to a prescribed value.

In the first aspect as described above, the direction controlled by the step track is that of revision of the offset error correction value, but no concrete description of a quantity of revision is given. There are various methods of calculating the quantity of revision. In the present aspect, a value of the quantity of revision is determined in proportion to the degree of the convergence of the offset error correction value. In other words, as convergence progresses, the quantity of revision is reduced. Conversely speaking, the more incomplete the convergence, the larger the quantity of revision will be. As a result, if the convergence is still incomplete and the error is large, the quantity of revision will also be large. Therefore, it is possible to achieve prompt convergence of the correction value.

There are some ideas about a method of quantitatively indicating the degree of convergence. For example, it is preferable to determine the degree of convergence based on the length of a cycle of the revision. This idea will be explained in a fourteenth aspect of the present invention.

In order to solve the problems described above, in an eighth aspect of the present invention, the aforementioned revising means includes (1) convergence detecting means for detecting whether or not the convergence of the aforementioned offset error correction value to a prescribed value is achieved and (2) revision frequency changing means for changing frequency of the revision of the aforementioned correction value, which is made by the revising means by adding the quantity of revision to the correction value, before and after the aforementioned convergence detecting means detects convergence.

After the convergence of the offset error correction value to a prescribed value, the correction value will be revised, even when the decline of the reception level is very small, which causes error to increase. For such a reason, it is preferable to adopt a second convergence correction method before and after the convergence of the correction value. By changing the frequency of revision before and after the convergence, the eighth aspect of the present invention prevents the error from increasing after convergence.

In order to solve the problems described above, in the ninth aspect of the present invention which is a vehicle mounted satellite signal receiving apparatus based on the seventh or eighth aspects as described above, the aforementioned revising means includes (1) accumulating means for summing up the quantity of revision in the direction controlled by the aforementioned step tracking means and retaining the accumulated value when the aforementioned reception level falls below the aforementioned prescribed value. Control of the direction is commenced by the aforementioned step tracking means and (2) adding means for adding quantity of revision summed up by the aforementioned accumulating means to the aforementioned offset error correction value and clearing the accumulated value summed up by the aforementioned accumulating means at every prescribed interval.

After convergence of the offset error correction value, the quantity of revision of the correction value is small. As a result, a substantial steady state, such as a repetition of reciprocal reverse directional revision, may arise. In such a steady state, it is preferable to reduce such a reciprocal reverse directional revision which is almost meaningless. Under the circumstances, in the present invention No. 9, the quantity of revision is summed up, and the sum total of the quantity of revision is added to the correction value. As a result, the repetition of reciprocal reverse directional revision can be substantially prevented, whereby the offset error correction value can be revised in a stable manner.

In order to solve the problems described above, a tenth aspect of the present invention, the aforementioned revising means includes (1) accumulating means for summing up the quantity of revision in the same direction as the direction controlled by the aforementioned step tracking means and retaining the accumulated value when the aforementioned reception level falls below the aforementioned prescribed value and the aforementioned step tracking means commences to control the direction and (2) adding means for checking the quantity of revision summed up by the aforementioned accumulating means at every prescribed interval and adding quantity of revision summed up to the aforementioned offset error correction value and clearing the accumulated value summed up by the aforementioned accumulating means only when the quantity of revision is in excess of a prescribed threshold value.

In the present invention No. 9 described above, the sum total of the quantity of revision is added to the correction value, whereby the offset error correction value can be revised in a more stable manner. However, as described above, in a substantial steady state such that reverse directional "minute" revision is alternately repeated, there are many cases that the value of the total sum is "minute." In such a case, revision of the correction value is almost meaningless. Therefore, it is better to reduce the revision. In the present invention No. 10, the quantity of revision is added to the correction value only when the total sum of the quantity of revision is greater than or equal to a threshold value. Consequently, such meaningless addition of the quantity of revision can be prevented, thereby enabling the stable revision of the offset error correction value.

Examples of preferable revisions could include the following. If the quantity of the revision of correction value to be performed is −1 to +1, the revision will not be performed. If the quantity is −2 to −4, the revision will be made by −1. If the quantity is −5 or less, the revision will be made uniformly by +2. If the quantity is +5 or more, the revision will be made by −2.

In order to solve the problems described above, in an eleventh aspect of the present invention based on the first aspect, the aforementioned revising means includes convergence detecting means for detecting whether or not convergence of the aforementioned offset error correction value to a prescribed value is achieved, and the aforementioned step tracking means includes control interval setting means for setting a control interval, which is an interval of sampling satellite signals, to a different value depending on when the aforementioned convergence detecting means detects the convergence of the aforementioned correction value.

If the interval of sampling satellite signals is exceedingly long prior to the convergence of the offset error correction value, the rotation angle of antenna per unit time will become large. This causes an overrun, whereby tracking cannot be performed. On the other hand, if the sampling interval is too short after the convergence of the correction value, it will be impossible to distinguish an increase or decrease of the reception level over the noise.

Under the circumstances, in the present invention No. 11, it is directed to improve the tracking performance by providing variation in the control interval before and after the convergence of the offset error correction value.

In order to solve the problems described above, in the present invention No. 12 which is a satellite signal receiving apparatus to be mounted on vehicles according to the present invention No. 1 described above, the aforementioned revising means includes convergence detecting means for detecting whether or not convergence of the aforementioned offset error correction value to a prescribed value is achieved, and the aforementioned step tracking means includes angular velocity setting means for setting an angular velocity of rotation of the aforementioned antenna to different values depending on when the convergence of the aforementioned correction value is detected by the aforementioned convergence detecting means.

If a value of the aforementioned angular velocity is not larger than a value of the offset error in the gyro sensor, it will be impossible to return from step tracking to gyro tracking. On the other hand, if the value of the angular velocity is larger than that of the offset error in the gyro sensor after the convergence of the offset error correction value, an overrun will arise. Therefore, it is necessary to maintain a small angular velocity.

Under the circumstances, in a twelfth aspect of the present invention, an angular velocity of step tracking, namely, a so-called "step rate" is altered before and after convergence of the correction value. Due to such a constitution, the tracking performance can be improved.

In order to solve the problems described above, in a thirteenth aspect of the present invention, the aforementioned revising means revises the aforementioned offset error correction value only when the angular velocity of azimuth rotation of the vehicle detected by the aforementioned gyro sensor is below a prescribed value.

Errors which arise in a gyro sensor are usually classified as either offset errors or sensitivity errors. An offset error is an error such that a certain value is applied to an output signal of the gyro sensor, regardless of the value of output signal of the gyro sensor. The sensitivity error is an error such that the value of an output signal of the gyro sensor grows small or large at a certain rate.

If the absolute value of an output signal of the gyro sensor is small, an offset error will be much larger than a sensitivity error. Therefore, the sensitivity error can be ignored. However, if the rotation velocity of vehicle detected by the gyro sensor is large, it will be difficult to demarcate the sensitivity error and the offset error. If the rotation velocity of vehicle equals or exceeds a prescribed value, there will be influence the sensitivity error as well as the offset error. Therefore, it is preferable not to revise the offset error correction value. Under the circumstances, in the thirteenth aspect, revision of the offset error correction value is carried out only when the rotation velocity of vehicle is below the prescribed value.

In order to solve the problems described above, in a fourteenth aspect of the present invention based on the seventh aspect described above, the aforementioned deciding means includes means for fixing a value of the aforementioned quantity of revision basing on a cycle of the revision performed by the aforementioned revising means.

In the seventh aspect, the quantity of revision is decided by the deciding means in accordance with a degree of the revision. It is preferable to determine the degree of revision based on a cycle of the revising operation which the quantity of revision is added to the offset error correction value. More specifically, if the revising operation is frequently carried out in short cycles, in order to promptly achieve the convergence of the correction value, it will be preferable to use a comparatively large value as a value of the quantity of revision by judging that a degree of the convergence is low.

If the revising operation is carried out in a long cycle, it will be appropriate to judge that the correction value is almost convergent to the prescribed value and the degree of convergence is high. Therefore, in such a case, in order to achieve convergence to a precise value, it is preferable to use a comparatively small value as a value of the quantity of revision.

From such a point of view, in the fourteenth aspect, the degree of error is estimated based on the cycle of the revising operation of the correction value. Therefore, a prompt convergence of the correction value can be realized and a precise correction value can be obtained.

In order to solve the problems described above, in the fifteenth aspect of the present invention, includes (1) revision cycle measuring means for measuring a revising cycle which is a time interval of the revision of the aforementioned correction value performed by the aforementioned revising means, (2) offset error calculating means for calculating a value of the offset error of the gyro sensor, basing on the revising cycle which has been measured by the aforementioned revision cycle measuring means, and (3) second revising means for revising the aforementioned offset error correction value to a true correction value of the aforementioned gyro sensor by adding the value of the offset error calculated by the aforementioned offset error calculating means to the offset error correction value.

The aspects of the present invention described above adopt a method of gradually revising the offset error correction value without finding the value of the offset error. However, in gyro tracking, the direction of a BS antenna deviates from that of the satellite because the offset error correction value differs from the true offset error. The angular velocity of deviation of the aforementioned BS antenna is considered to be equal to the angular velocity of the difference between the offset error correction value and the true offset error. In other words, it is a theory of gyro tracking that if a BS antenna is rotated at the same angular velocity as that of rotation of vehicle detected, the antenna will always point to a constant direction (to the direction of a satellite). Therefore, as long as the offset error is X (rad/sec), even though the vehicle is not rotating, it will be determined that the vehicle is rotating at an angular velocity of X (rad/sec). Therefore, the BS antenna rotates at an angular velocity of X (rad/sec).

If the direction of the BS antenna gradually deviates from the direction of the satellite during the gyro tracking, an angular velocity of the deviation will be an angular velocity of the difference between the offset error correction value and the true offset error. If the difference is zero, it is a matter of course that the BS antenna will always point to the satellite.

From the description above, it is conceivable to search a directivity of the BS antenna in advance and confirm how many times the antenna rotates during a change of the reception level from a prescribed value to another prescribed value. For example, it is conceivable that a period of time required for changing the reception level from $L_C$ to $L_B$ is measured and basing on the angle and time period, the angular velocity of the BS antenna during the change is calculated. As a matter of fact, however, not only a sensitivity error, but also conditions of propagation of various radio waves are causes for changing the reception level. Therefore, it is generally difficult to adopt this method.

In the aspects of the present invention described above, when a changeover from gyro tracking to step tracking is performed, the offset error correction value is revised. Therefore, it is preferable that timing of measuring the time period is fixed based on the changeover moment. More specifically, measurement should begin when the changeover from gyro tracking to step tracking is performed subsequently to the following sequential processes: a commencement of step tracking, a rise of the reception level, a changeover from step tracking to gyro tracking, and a decline of the reception level. The interval of this changeover represents a cycle of changeover from gyro tracking to step tracking.

In a preferred embodiment of the present invention, even though it is difficult to measure the angular velocity of a BS antenna in gyro tracking, it will be possible to calculate an angular velocity of the difference between the true offset error and the offset error correction value, based on this cycle "T" which will be described below.

First, $\omega_0$ (rad/sec) is defined as the difference between the true offset and the offset error correction value, $\Delta\phi$ (rad) is the angular difference of direction of BS antenna which corresponds to a certain reception levels LC and $L_B$ ($L_{C>LB}$), $t_1$ represents the time period of decline of the reception level from $L_C$ to $L_B$ in the case that the BS antenna rotates during the gyro tracking due to the discordance of the offset error correction value and the true offset error ($\omega_0 \neq 0$) (as will be described later, t1 is not measured separately), and $t_2$ stands for a time period of restoration of the reception level from $L_B$ to $L_C$ in the case the BS antenna rotates in the right direction of a satellite during the step tracking (as will be described later, $t_2$ is not measured separately). Further, a step rate in the step tracking by $\omega S$ is designated. Then, the time period $t_1$ corresponding to decline of the reception level from $L_C$ to $L_B$ and the time period $t_2$ corresponding to the restoration of the reception level from $L_B$ to $L_C$ can be respectively designated as follows.

$t_1=\Delta\phi/\omega_0$; $t_2=\Delta\phi/(\omega_0+\omega S)$

Here, assuming that the reception level LC is a reception level at the time of switching the tracking method from step tracking to gyro tracking and the reception level $L_B$ is a reception level at the time of switching it from gyro tracking to step tracking, the aforementioned cycle T of changeover from gyro tracking and step tracking is apparently designated by "$T=t_1+t_2$." Therefore, the following equation can be derived.

$$\begin{aligned} T &= t_1 + t_2 \\ &= \Delta\phi/\{1/\omega_0 + 1/(\omega 0 + \omega S)\} \end{aligned}$$

If the cycle T and the step rate ωS are determined, and the rotation angle of a BS antenna Δø corresponding to the reception levels $L_C$ and $L_B$ are measured in advance, $\omega_0$ can be calculated using this equation.

In such a manner, even though $t_1$ is obscure, it will be possible to calculate the angular velocity $\omega_0$ of the difference between the offset error correction value and the true offset error by measuring the cycle T which is the sum of $t_1$ and $t_2$.

In a preferred embodiment which will be described hereunder, it is assumed that the step rate ωS is sufficiently larger than $\omega_0$. Also, it is considered that "1/ω0+1/(ω0+ωS)" is almost equal to "1/ω0." The aforementioned equation is used in a state of being changed as follows.

$T=\Delta\phi/\omega 0$

From this equation, it is possible to write "ω0=Δø/T" to stand for the difference ω0 between the true offset error and the offset error correction value.

BRIEF DESCRIPTION OF THE DRAWINGS

FIG. 13 B is an explanatory drawing showing tracking operations of a conventional vehicle mounted satellite signal receiving apparatus.

FIG. 13 C is an explanatory drawing showing tracking operations of a conventional vehicle mounted satellite signal receiving apparatus.

DESCRIPTION OF THE PREFERRED EMBODIMENTS

Preferred embodiments of the present invention will subsequently be explained with reference to the attached drawings.

Figure 1:
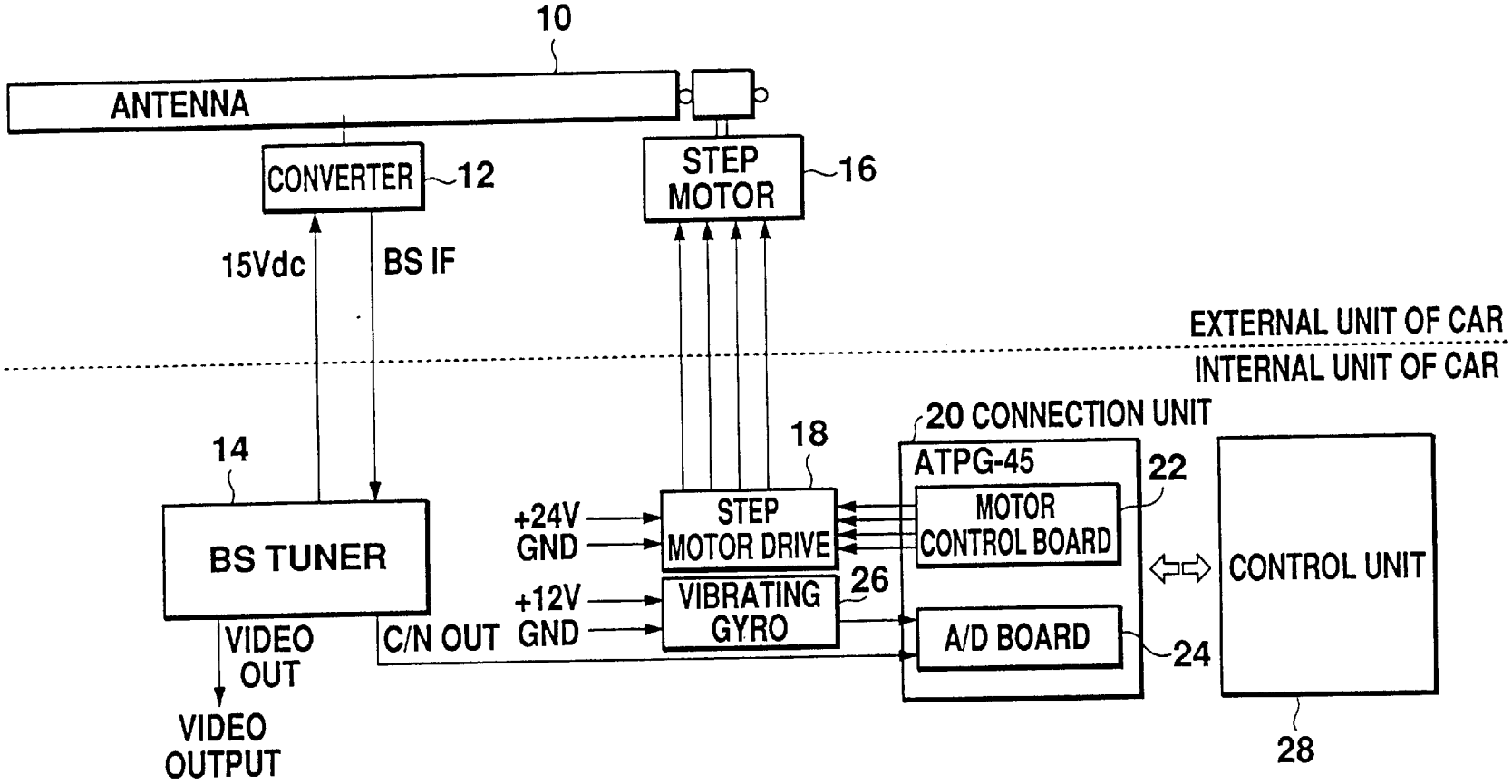
FIG. 1 is a block diagram showing a constitution of a vehicle mounted satellite signal receiving apparatus which includes a satellite tracking device.

FIG. 1 is a block diagram showing a vehicle mounted satellite signal receiving apparatus with a satellite tracking device, of a first embodiment of the present invention. As shown in FIG. 1, a BS antenna 10 is connected to a BS tuner 14 installed in a car via a converter 12. The antenna 10 and the converter 12 are fitted to the exterior of the car as external units of the car. As shown in FIG. 1, the antenna 10 is furnished with a step motor 16 whose constitution is such that the direction of the antenna can be varied. The step motor 16 is driven by a step motor driver 18, which is one of the interior units of the car. The step motor driver 18 is controlled by a motor control board 22, which is fitted to the inside of a connection unit 20. The connection unit 20 includes an A/D board 24 besides the motor control board 22. The A/D board 24 receives output signals of a vibrating gyro 26 fitted to the vehicle and C/N signals of the aforementioned BS tuner 14. The A/D board 24 has a function of converting analog signals received into digital signals. A control unit 28 is connected to the connection unit 20. According to signals from the control unit 28, the motor control board 22 controls the step motor 16 via the step motor driver 18. On the other hand, the control unit 28 carries out prescribed control, such as gyro control or step track control as will be described later, by inspecting digital signals outputted from the A/D board 24.

In such a constitution, the control unit 28 at first searches the current reception level immediately after the power is supplied. The search of this reception level is performed in a manner that the C/N signals outputted from the BS tuner 14 are inspected through the A/D board 24. If the reception level searched by the control unit 28 is below a prescribed threshold value, it will be determined that the direction (azimuth) of the antenna does not coincide with the direction of a satellite. The initial searching operation is then performed. On the other hand, if the reception level is in excess of a prescribed threshold, it will be determined that the azimuth of a beam of the antenna 10 is almost in the direction of the satellite, thereby shifting to tracking operation.

In the initial searching operation, the antenna 10 is rotated with the reception level being monitored, and when the reception level exceeds the prescribed threshold value, the rotation of the antenna 10 is terminated. Next, necessary operations are performed so as to advance to the following tracking operation.

In the tracking operation, output signals of the vibrating gyro 26 and reception levels are read out and the azimuth of the antenna 10 is controlled. As described above, the output signals of the vibrating gyro 26 and the reception level are converted into digital signals through A/D board 24 and then supplied to the control unit 28. The control unit 28 suitably performs gyro control and step track control according to the digitized signals.

It is preferable that the initial searching operation is composed of two states, namely, a high speed searching state and a low speed searching state. First, the antenna is rotated on a large scale after the power is supplied and the rotation is continued until the reception level becomes high. When the once raised reception level declines, the initial searching operation is shifted to the low speed searching state. Then, the antenna is rotated slowly so that the maximum point of the reception level can be accurately traced.

As described above, the tracking operation is performed by gyro control or step track control. The gyro control is a method of controlling a beam of the antenna 10 to point to a satellite by rotating the antenna 10 at an angular velocity ($-\omega G$) which is equal to the circulation angular velocity ($\omega G$) of a vehicle detected by the gyro sensor and has a sign opposite to that of the aforementioned circulation angular velocity.

Due to such gyro control, a rotation angular velocity of the antenna can be smoothly controlled coping with the variation of azimuth resulting from circular movement of a vehicle. This prevents rapid variation of the load which is applied to the step motor 16. Therefore, it will be possible to perform a proper satellite tracking even though the vehicle makes a circular movement at a comparatively high speed. However, as explained in the aforementioned "Description of the Related Art," there is a case that a gyro output is under the influence of an offset error and a temperature drift of the offset error, and the quantity of control of the step motor 16 to rotate the antenna 10 deviates from an actual rotation angular velocity of the antenna 10. Therefore, it is usually necessary to adjust the direction of a beam of the antenna 10 to that of the satellite using some other method. In the case of gyro control, if a control interval, namely, a cycle of detecting the circulation angular velocity of the vehicle $\Delta T$ is shorter, it will be more likely to minimize the azimuth error of the antenna even when the circulation angular velocity varies rapidly. Therefore, it is generally preferable to set a short control interval $\Delta T$.

Figure 2:
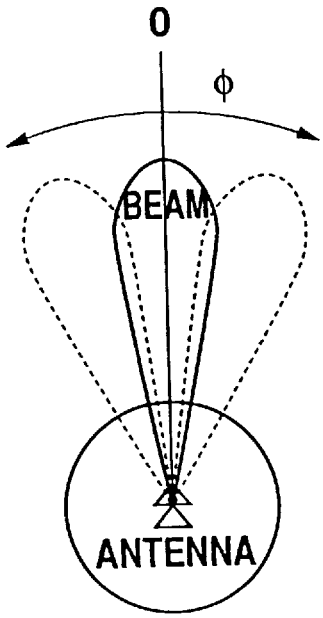
FIG. 2 is an explanatory drawing showing a principle of the step track control.

On the other hand, the step track control is a method for causing the azimuth of a beam of the antenna 10 to point to a satellite by rotating the antenna 10 to the direction which the reception level increases after the maximum reception level is searched in a manner that the beam of the antenna 10 is swung slightly with the beam pointing to the azimuth direction. FIG. 2 is an explanatory drawing showing a principle of step track control. In concrete, the control unit 28 reads out reception levels at every regular time interval $\Delta T$ through the A/D board. If the current reception level is higher than the reception level read out $\Delta T$ time ago, the antenna 10 will be continuously rotated in the same direction as that of $\Delta T$ time ago at a certain angular velocity $\omega S$. In contrast with this, if the current level is lower than the reception level read out $\Delta T$ time ago, the antenna 10 will be rotated in the direction opposite to that of $\Delta T$ time ago at a certain angular velocity $\omega S$. The symbol $\omega S$ in this step track control is called "step rate." In such step track control, in order to follow up a high speed circulation of the vehicle, it is required to set the angular velocity $\omega S$ to a value which is as much as a circulation angular velocity $\omega S$ of the vehicle because the rotation of the antenna 10 may not be able to follow up the circulation of the vehicle if the antenna 10 is rotated at an angular velocity $\omega S$ which is lower than the maximum circulation angular velocity of the vehicle. However, in an actual apparatus, as a rotating portion has a moment of inertia, it is difficult to rotate such a part at a high speed and in a state of step. Consequently, there are many cases that it is impossible to follow up a high speed circulating movement of the vehicle.

In the case of step track control, if a control interval $\Delta T$ is short, quantity of variation of the reception level (quantity of variation to be detected) will become small and the direction of control will be affected by a supplementary thermal noise. This occasionally makes it impossible to detect accurate directions of control. In a worst case, the direction of a beam of the antenna 10 may completely deviate from that of a satellite. Therefore, the control interval $\Delta T$ which is a time interval of detecting the reception level in the step track control should be set to long to some extent.

Figure 3:
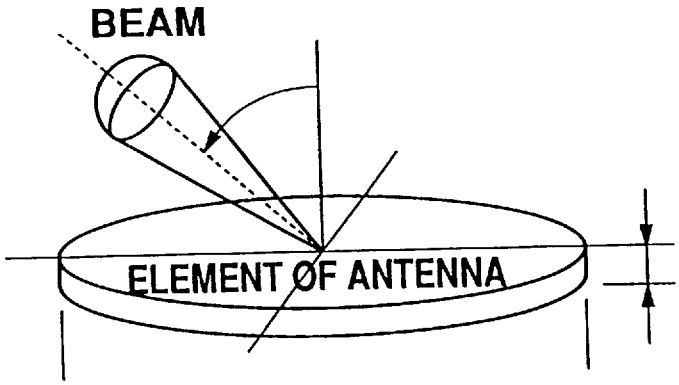
FIG. 3 is an explanatory drawing of a plane beam tilt antenna.
Figure 4:
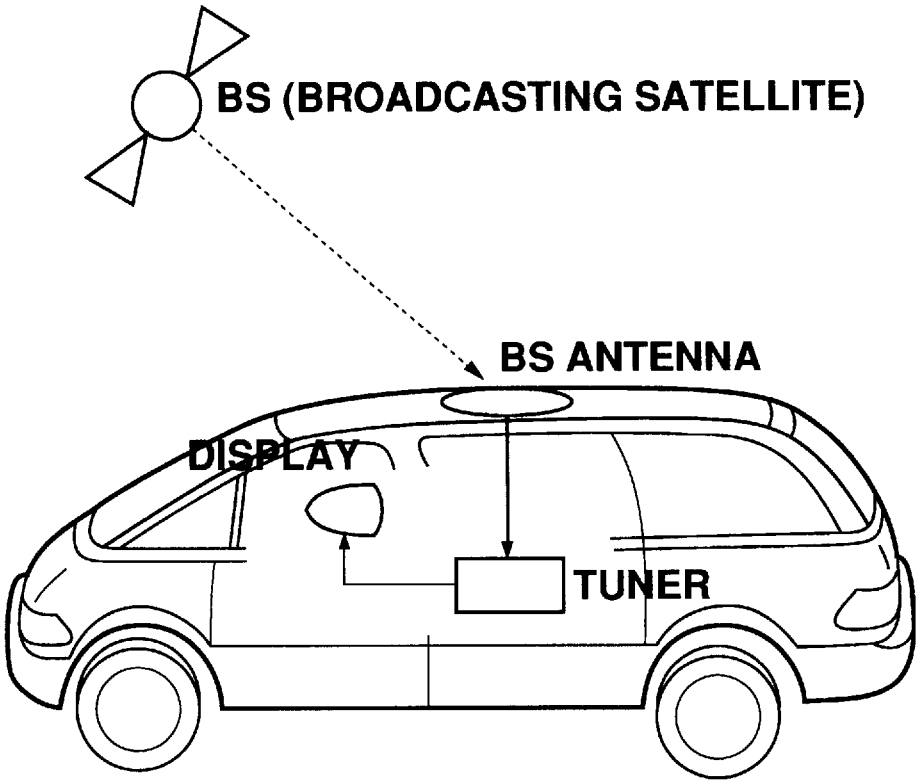
FIG. 4 is an explanatory drawing showing the plane beam tilt antenna installed on the roof of a vehicle.

In this embodiment, any type of antenna is applicable as long as it has a certain directivity, it is preferable to use a plane beam tilt antenna which is shown in FIG. 3. The plane beam tilt antenna is a plane antenna whose beam is tilted by a certain angle from a vertical direction by adjusting a phase of each element of the antenna. The directivity of the antenna is fixed to the direction shown in FIG. 3, and the altitude of a BS does not vary. Therefore, it is theoretically possible to cause the beam of the antenna to point to the BS by horizontally rotating the plane antenna shown in FIG. 3 as long as the vehicle is moving horizontally. Such a plane antenna can be formed thin, so that it can be installed on a roof of a vehicle (passenger car) as shown in FIG. 4. It may be preferable to build the plane antenna into a sun roof.

The aforementioned gyro control and step track control have demerits as well as the merits as described above. Therefore, a control method is proposed that is a combination of the gyro control and step track control. More specifically, in this method, a variation of azimuth resulting from circulation of the vehicle is prevented by an output of the gyro sensor, and azimuth errors which the gyro sensor cannot prevent are prevented by the step track control. In the satellite tracking apparatus according to this embodiment, a tracking system which is a combination of the gyro control and step track control is adopted. In this text, the aforementioned combined method is called "hybrid control."

In hybrid control, the antenna 10 is rotated by using the sum ($-\omega G+\omega S$) of (1) a value ($-\omega G$) which is equal to the circulation angular velocity ($\omega G$) of the vehicle detected by the vibrating gyro 26 and has a sign opposite to that of the aforementioned circulation angular velocity and (2) a value ($\omega S$) which is derived from multiplication of a certain angular velocity $|\omega S|$ by a sign (positive or negative) which is determined basing on the difference in the levels between the reception level of $\Delta T$ time ago (C/N signal) and the current reception level. Here, the step rate $\omega S$ is a value, the absolute value of which is a prescribed value and which can have either positive or negative sign.

For hybrid control (combined control of the gyro control and step track control), the control unit 28 reads out output signals of the vibrating gyro 26 at every $\Delta t$ time through the A/D board 24. A rotation angular velocity of the antenna 10 is determined by superimposing the quantity of control $\omega S$ ($+|\omega S|$ or $-|\omega S|$) for the step track on a value which has a sign opposite to that of an output signal of the gyro sensor (a rotation angular velocity of the vehicle).

As described above, quantity of control for the step track control $+|\omega S|$ or $-|\omega S|$ is renewed at every $\Delta T$ time. Here, the control interval AT for the step track is selected so that the equation is $\Delta T=M^X\Delta t$ (M is an integer). In other words, the control interval $\Delta T$ for the step track is set to be an integral multiple of the control interval $\Delta t$ for the gyro control. For example, in this embodiment, M is set to be six. In other words, $\Delta T$ is a time period six times $\Delta t$. As described above, for gyro control it is desirable that the control interval $\Delta t$ be short. However, for step track control, in order to perform stable control $\Delta T$ must be longer. Therefore, $\Delta T$ is set to be longer than $\Delta t$.

Thus, hybrid control, a combination of gyro control and step track control, is expected to make the best use of the merits of both systems and perform an appropriate satellite tracking in a vehicle which is making a circular movement at a high speed.

As described above, even in a satellite tracking system which can make the most use of the merits of both methods, temperature drift and time drift of the offset error of the gyro sensor still exist. Therefore, even in the combined control of these, it is expected to have a method of successively correcting the offset error of vibrating gyro 26.

A second configuration of the first fundamental embodiment of the present invention is directed to enabling accurate satellite tracking by automatically revising a correction value in order to cope with drift arising in an offset error during satellite tracking by the hybrid control. The fundamental principle of the present invention to achieve the object is that if a transition between the step track control and the hybrid control arises during the hybrid control, the offset error will be regarded as the cause and a correction value of the offset error will be revised.

Operation of the hybrid control (tracking) according to the embodiment of the present invention will be subsequently described.

Figure 5:
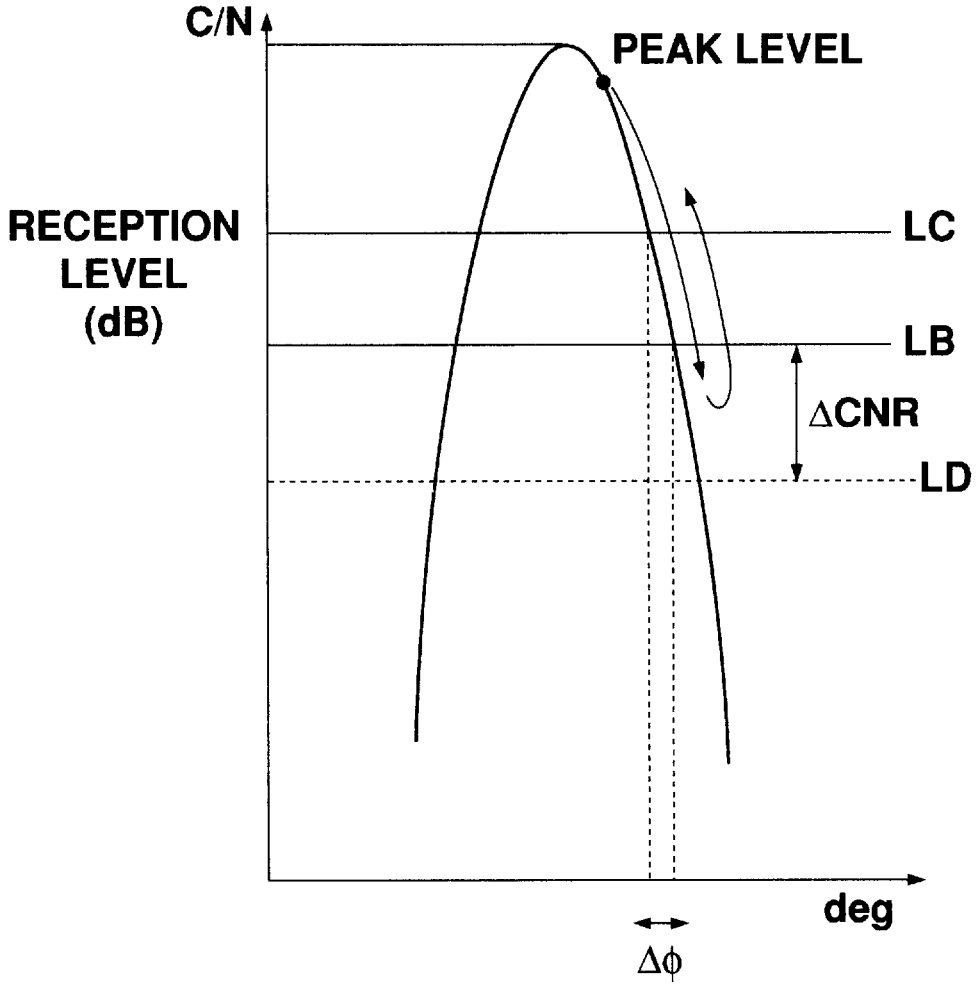
FIG. 5 is a graph showing the relation of a reception level and an angle of deviation between the antenna's beam and a satellite.

As shown in FIG. 5, in the embodiment of the present invention, if the reception level is below a threshold value $L_C$, tracking will only be performed according to outputs of the gyro sensor. If the reception level is above a threshold value $L_B$, it is proposed to adopt the method of revising the correction value of the gyro drift error executed in a tracking system in which the hybrid tracking is performed according to C/N outputs. In this embodiment of the present invention, the description does not cover step tracking but covers hybrid tracking which simultaneously uses gyro tracking and step tracking. In this embodiment, an example of hybrid tracking is shown. However, as long as some constituent of step tracking is included, even though another tracking method or a pure step tracking is executed, it will be within the technical scope of the present invention.

In this embodiment, a threshold at the time of shifting from the gyro tracking to the hybrid tracking resulting from a decline of the reception level is $L_B$ as described above. A threshold value at the time of shifting from hybrid tracking to gyro tracking resulting from a rise of the reception level is called $L_C$.

For example, if the reception level at the time of gyro tracking is a point which is shown by a black spot in FIG. 5, several seconds after a drift arises in the offset error of the vibration gyro 26 the point representing the reception level will shift to the right or left. Further, the reception level will drop below the threshold $L_B$ and the tracking method will be shifted to hybrid tracking (or step tracking). The hybrid tracking has a restoring force and therefore the antenna 10 is rotated to the direction of a high C/N signal. Consequently, the reception level increases to the threshold value $L_C$ or more, and the tracking method is shifted back to gyro tracking. At this time, a small quantity of revision $\Delta W$ is added in the direction of CW (or CCW) to a correction value of the offset error which arises in outputs of the gyro sensor. For example, if the black spot shifts to the right during the gyro tracking, the antenna 10 will move to the left (CCW). Therefore, correction is performed in the direction of CW. If the offset error still remains in spite of such revision, the aforementioned operations will be repeatedly executed until the offset error correction value is convergent to the optimum value.

A characteristic feature of this embodiment is that based on the direction of rotation (a sign of $\omega S$) of the step track at the time the tracking method is shifted from hybrid tracking to gyro tracking, whether the offset error is in the direction of CW or CCW is determined. For example, if the step track rotates in the direction of CW at the time of shifting to the gyro tracking, it will be determined that an output signal of the gyro sensor deviates to the direction of CW from the true value and the gyro track rotates the antenna in the CCW direction. Consequently, if the step track rotates in the direction of CW, the correction value of the offset error which arises in the output signal of the gyro sensor will be revised in the direction of CCW. Thus, in this embodiment, even though a drift arises in the offset error, a correction value of the error can be automatically revised. Therefore, an accurate correction of the offset error can be performed at all times.

In the fundamental embodiment described above, even in such a case that the reception level temporarily falls below the threshold value $L_B$ due to interruption by a tree or a building and the reception level then rises above the threshold value $L_C$, the correction value of the offset error is revised. In a case where the reception level instantaneously falls, due to a tree, for example, the correction value of the offset error should not be revised. Therefore, if the tracking method is shifted to the hybrid tracking resulting from such an instantaneous decline of the reception level under the condition that the reception level has fallen below the threshold value $L_D$ (threshold value $L_B-\Delta CNR$) at least once for the past T seconds, in order to prevent the revision of the correction value of the offset error, it is preferable not to renew the correction value by determining that the decline is due to an instantaneous interruption of radio waves by a tree or the like.

Figure 6:
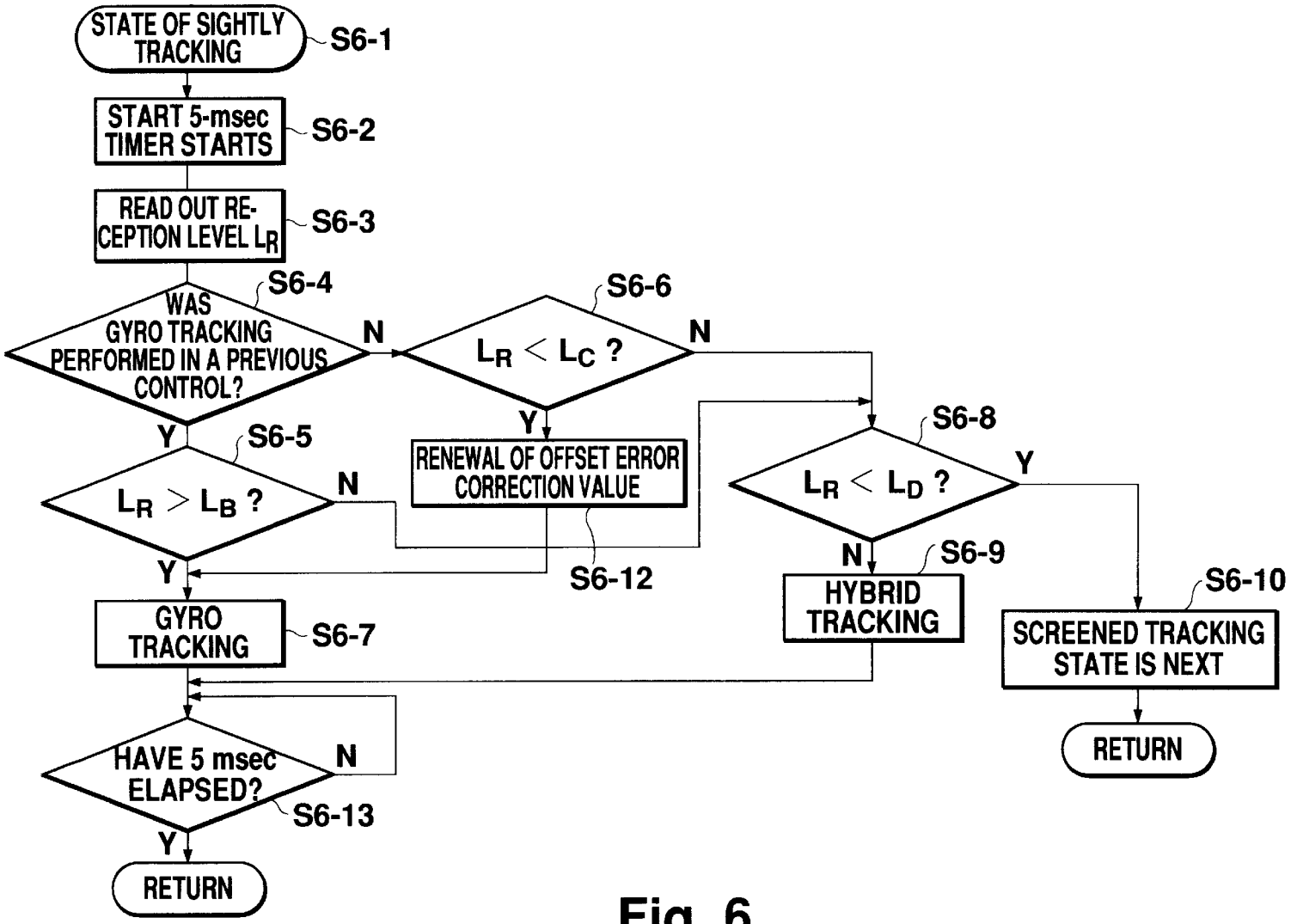
FIG. 6 is a flowchart showing tracking operations of the vehicle mounted satellite signal receiving apparatus in an embodiment of the present invention.

FIG. 6 is a flowchart showing the tracking operation of a satellite signal receiving apparatus according to this embodiment of the present invention.

This flowchart, begins in step S6-1 with a step state in which radio waves are not interrupted by a tree or the like ( a state of sightly tracking). At Step 6-2, a 5-msec-timer starts. A time period set to the timer corresponds to the aforementioned $\Delta t$ and is a control interval for the gyro control.

At Step S6-3, the reception level $L_R$ is read out. At Step 6-4, a test is performed in order to determine whether or not the gyro tracking was carried out in a previous control of 5 milliseconds ago. If it is determined that gyro tracking was performed, the processing program will advance to Step 6-5. If it is determined that gyro tracking was not performed, the processing program will advance to Step S6-6.

Figure 7:
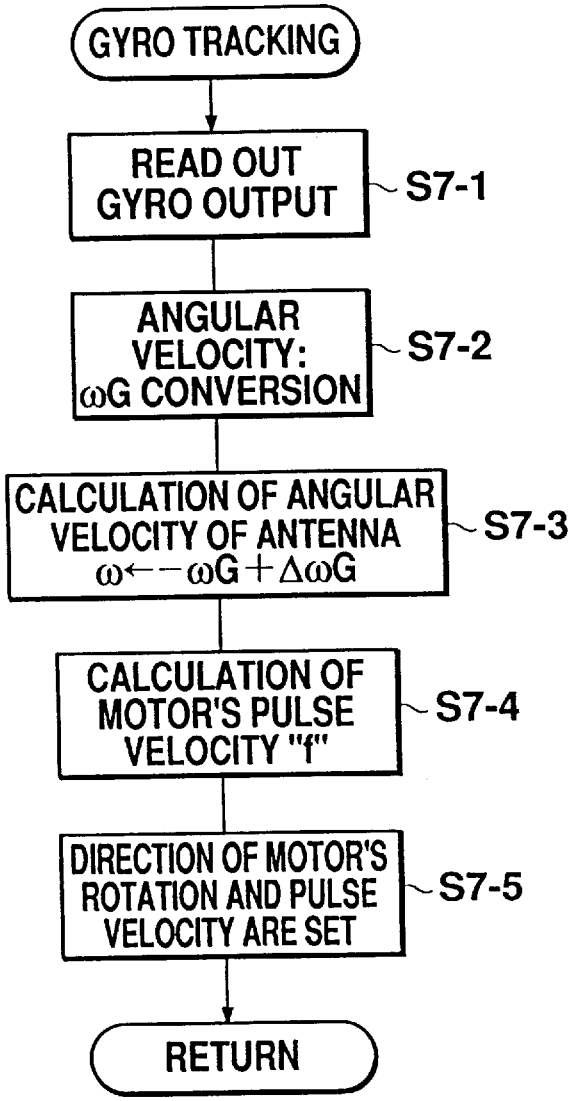
FIG. 7 is a flowchart showing tracking operations shown in the flowchart of FIG. 6, focusing on gyro tracking operations.

At Step S6-5, a test is performed in order to determine whether or not the reception level is in excess of the threshold value $L_B$. If it is determined that the reception level exceeds the threshold value $L_B$, the processing program will advance to Step S6-7 where the gyro tracking is performed. If the reception level does not exceed the threshold, the processing program will advance to Step S6-8. A detailed flowchart of Step S6-7 is shown in FIG. 7.

Figure 8:
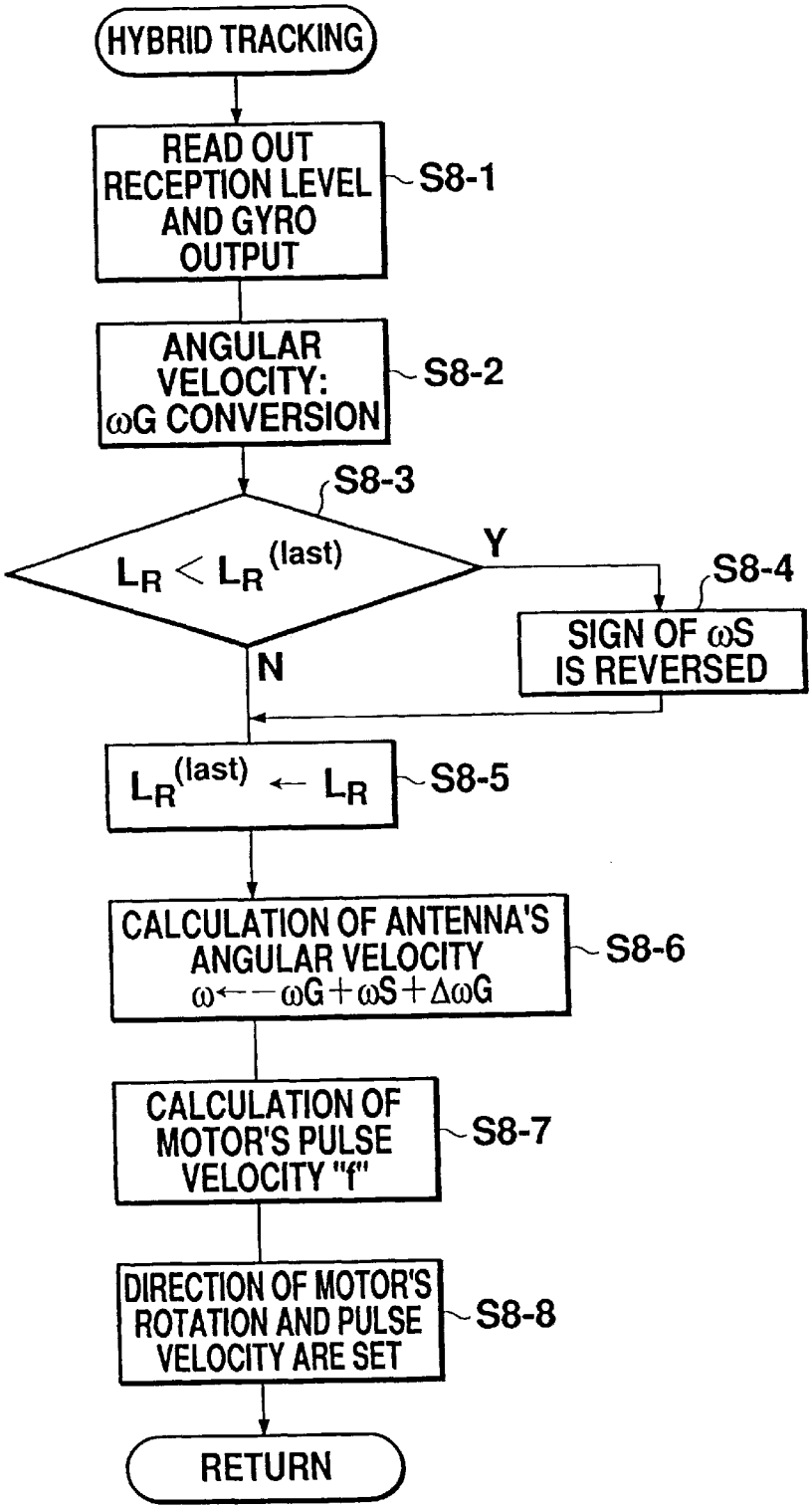
FIG. 8 is a flowchart showing tracking operations shown in the flowchart of FIG. 6, focusing on hybrid tracking operations.

At Step S6-8, a test is performed in order to determine whether or not the reception level $L_R$ is below the threshold value $L_D$ (threshold value $L_B-\Delta CNR$). If the reception level $L_R$ is not below the threshold value $L_D$, the processing program will advance to Step S6-9 where the hybrid tracking is performed. A detailed flowchart of Step S6-9 is shown in FIG. 8. If the reception level LR is below the threshold value $L_D$, it will be determined to be a state of screened tracking, thereby shifting to Step S6-10.

At Step S6-10, the tracking state is shifted to a state of screened tracking. In the screened tracking state, the correction value of the offset error is not revised. In this state of tracking, if the reception level is restored to be above the aforementioned threshold value $L_D$ within a prescribed time period (for example, 10 seconds), the processing program will return to Step S6-1 where sightly tracking is performed. However, if the reception level is not restored within the prescribed time period, a series of operations beginning at the time of supplying the power will be performed once more. In other words, a state of reset will be created.

On the other hand, at Step S6-6, a test is performed in order to determine whether or not the reception level $L_R$ is in excess of the threshold value $L_C$. If the reception level $L_R$ exceeds the threshold value $L_C$, the processing program will advance to Step S6-12 where the offset error correction value is revised. If the reception level $L_R$ is below the threshold value $L_C$, the processing program will advance to the aforementioned Step S6-8.

Finally, if the tracking process to be performed in Step S6-7 or Step S6-9 is completed, the processing program will advance to Step S6-13. At Step S6-13, a test is performed in order to determine whether or not five milliseconds have elapsed. This period of five milliseconds corresponds to the control interval Δt of the gyro tracking.

In FIG. 7, a flowchart of the gyro tracking is shown. At Step S7-1, outputs of the gyro sensor are read out. At Step S7-2, the aforementioned outputs are converted into the angular velocity ωG. At Step S7-3, an angular velocity of the antenna 10 is calculated. Here, ΔωG represents a correction value of the offset error which arises in the output of the gyro. The right angular velocity is calculated by using an equation "ωG−ΔωG." Therefore, the angular velocity of the antenna 10 is found from an equation "ω=−(ωG−ΔωG)=−ωG+ΔωG."

At Step S7-4, basing on a sign ω derived, a pulse velocity f of the motor is calculated. At Step S7-5, a direction of rotation of the motor and the pulse velocity are set. In the manner described above, the gyro tracking is performed.

In FIG. 8, a flowchart of the hybrid tracking is shown. At Step S8-1, the reception level LR and an output of the gyro sensor are read out. At Step S8-2, the aforementioned output of the gyro sensor is converted into the angular velocity ωG. At Step S8-3, a test is performed in order to compare the reception level $L_R$ (LAST) detected at the last time with the reception level $L_R$ detected at this time. If the value of the latter is below that of the former, the processing program will advance to Step S8-4 where the direction of rotation of the step track is changed. At Step S8-4, a sign ωS is reversed.

At Step S8-5, the reception level $L_R$ detected at this time is reserved as $L_R$ (LAST) so that it may be used for the next control. In other words, a renewal of LR (LAST) is executed. At Step S8-6, an angular velocity of the antenna 10 is calculated. In other words, the calculation is performed based on an equation "ω=−ωG+ωS+ΔωG." As described above, ωG is an angular velocity of the output of the gyro sensor, ωS is a step rate, and ΔωG is the correction value of the offset error. At Step S8-7, based on a derived sign ω, the pulse velocity f of the motor is calculated. At Step S8-8, the direction of rotation of the motor and the pulse velocity are set. In the manner described above, the hybrid tracking is performed.

In the first fundamental embodiment described, for the purpose of preventing the offset correction value from being revised when the reception level C/N falls due to the roll of a vehicle, it is preferable not to revise the correction value as long as the roll angle is the threshold value or more by providing the gyro which detects a roll rate.

Due to the constitution described above, it is possible to perform a stable reception of satellite signals even when the vehicle rolls.

In the first fundamental embodiment described, if the offset error arises in the gyro sensor, a time waveform of the reception level C/N at the time of revising the offset correction value has a gentle inclination. In contrast with this, when reception of radio waves is interrupted by a tree or the like, an inclination of variation in radio waves received is generally very steep. Therefore, it is preferable not to revise the correction value when the inclination is above the prescribed value a for the past T seconds.

Due to the constitution of a third application as described above, even though the reception level C/N instantaneously falls because of interruption by a vehicle, a tree or the like, it will be possible to receive satellite signals in a stable manner.

In the first fundamental embodiment described, practical application of the embodiment is proposed as methods of preventing unnecessary revision in the first, second and third applications. However, a large error usually arises during the initial correction which is performed after supplying the power. Generally speaking, in order for the correction value to be convergent earlier, it would be better not to adopt the first, second or third application of the embodiment. Therefore, it is preferable to execute the fundamental embodiment described at first in such a state that convergence of the correction value is not completed after the power is supplied and to carry out the operations shown in the aforementioned applications after the convergence.

On the other hand, in a fourth application of the fundamental embodiment described above, it is characterized that a cycle of revision of the correction value is short when the offset error is large and it is long when the offset error is small. Therefore, methods shown in the aforementioned first, second or third application are executed only when a cycle of revision is in excess of a certain value. If this value exceeds the cycle of revision, it will be also preferable to execute the fundamental embodiment described at first.

In the method described for the aforementioned fourth application and in the satellite signal receiving apparatus applying this method, it is determined whether or not the aforementioned first, second or third applications are undertaken (only the fundamental embodiment described at first is undertaken) based on the length of a cycle of revision. However, it is also preferable to determine whether or not the aforementioned first, second, or third application are undertaken or not (only the fundamental embodiment described at first is undertaken) based on the following criteria.

It is assumed that a unit of the control interval of antenna is millisecond. An average value of the reception level C/N at N point during a time period starting at time t1 and ending Δt msec ago is expressed as CNRt. The objective inclination is set as β. The following value is computed in the expression below.

$$\sum_{i=-T}^{0} \{(CNR_i - CNR_{i-\Delta T}) - \beta\}^2 = \Sigma\Delta\beta$$

When ΣΔβ of the above equation becomes less than a certain value, it can be judged that the current inclination is β. Because the offset error is small if the inclination of the reception revel C/N is β, only when the inclination is smaller than β, the aforementioned applications are not implemented. When the inclination is more than β, it is appropriate that the fundamental embodiment described at first should be undertaken as it is.

In the fundamental embodiment mentioned above, a correction value is revised every time a decline of the reception level C/N occurs. Thus, if the correction value is revised whenever the decline occurs, the convergence can be prompted in the initial correction (the offset error is large at this time). Therefore, it brings in a favorable result. However, after the correction value becomes convergent once, the correction value tends to be revised even though a negligible decline in the reception level C/N arises, thereby allowing fluctuation of the correction value. Therefore, it is preferable in a sixth application of the embodiment to make a revision of the offset correction value used in practice at the end of a certain time period, while accumulating during the certain time period the quantity of revising the offset error at each occurrence of decline of the reception level C/N and memorizing the summation once the convergence is completed. For example, every $T_1$ second (multiplied period of cycle T of revising timing in the firstly mentioned fundamental embodiment), the sum of revised quantity of offset errors is added to the offset correction value.

Thus, stable correction of offset errors can be performed, reventing small fluctuation of a correction value from arising by adding the sum of revised quantity to the correction value after the convergence.

In other words, in the method shown in the aforementioned sixth application of the embodiment, it is possible that a value several times as large as the ordinary quantity of revision is added at one time, as the summation of revised quantity in $T_1$ seconds is added to the correction value every $T_1$ seconds. Defining the ordinary revised quantity in the fundamental embodiment described at first as Δω, for example, in a method of the aforementioned application which offset errors are revised as a whole in three times longer time, it is possible that the value of 3Δω is added to the offset error correction value.

Therefore, it is preferable in a seventh application of the embodiment to revise the correction value by Δω only when the following requirements are satisfied by the summation Σ of the offset error correction values to be carried out in every $T_2$ seconds (decline of reception level C/N happens at N times, and revision of the offset error correction values is N times after converting it to the fundamental embodiment described at first).

$$\Sigma/N>\beta$$

(β is $0 \leqq \beta \leqq$, however, β is preferable to be approximately 0.2 experimentally)

In other words, the method shown in the seventh application, which is different from the one shown in the aforementioned sixth application, does not vary quantity of revision but restricts it. For example, when the aforementioned T equals to 20 seconds and the timing of revising the offset error correction value arises five times during this 20 seconds, this method is restricted to make revisions of offset errors two times.

For example, in case that an apparent offset error falls in the range of −1 to +1, the offset error correction value should be revised by +1 to −1 according to the principle of the present invention. However, no revision is made in order to prevent small fluctuation of quantity of offset. If the range of apparent offset error is between −2 to −4, the offset error correction value is revised by −1 rather than revised −2 to +4. Similarly when it should be revised by −2 to −4, only +1 is revised, when expected revision is equal to or less than −5, it is revised by −2, and when expected revision is equal to or less than +5, actual revision occurs by +2. Of course, the aforementioned figures are hypothetical, and therefore optimum figures vary depending on each satellite tracking system.

In the fundamental embodiment described above, the time period for the convergence of correction value is required more because the correction value in the initial period after supplying the power (in case that the correction of offset error is not sufficient) is rather small in comparison with the total quantity of offset errors to be corrected. Therefore, it is considered appropriate that the quantity of revision Δω of correction value is varied according to the degree of convergence.

Now the degree of convergence is defined according to various criteria, and there are various methods of detecting the degree of convergence. For example, it is appropriate to use the cycle of revising the offset error correction value as a criterion to determine the degree of convergence. In order to use such a cycle as a criterion, it is preferable in an eighth application to use a timer which restarts every time the offset error correction value is revised. The value of such a timer is read out every time the offset error correction value is revised, and at the same time reset and restart is set out. By this method, the value of the timer read out becomes a cycle of the revision.

When the read cycle is larger than a certain threshold value, it is determined that the offset error correction value is coming to the convergence. Thus, a reference value of revision, which is a unit of one revision of the offset error correction value, is set small.

In other words, a reference quantity of revision (the aforementioned Δω), which is a unit of one revision of the offset error correction value, is set large throughout the determination that the offset error correction value is far from the convergence in case that the read cycle is not larger than a certain threshold value.

This mechanism makes a prompt revision possible in case that the convergence is away, and also a precise revision of the offset error correction value possible by undertaking careful revision in case that the convergence is nearing.

In the first fundamental embodiment error, which could be convergent, in the initial period after the power is supplied (a case that correction of offset error is not sufficient) is determined by the angular velocity of the hybrid tracking and the determination interval of reception level. On the other hand, after completing the convergence, the improvement of tracking performance cannot be achieved so long as the same determination interval is used as used in the initial period for the reception level. Therefore, in a ninth application of the embodiment it is preferable to change the angular velocity of the hybrid tracking and the determination interval for the reception level around the time when convergence arises.

If a large yaw rate is detected in the fundamental embodiment as described above, it is generally difficult to segregate an offset error from a sensitivity error. Consequently, only when a small yaw rate is detected, it is appropriate to revise the offset error correction value as it is in this embodiment. That is, when a yaw rate falls within the range between ±αdeg/sec, the sensitivity error can be ignored because it is smaller than an offset error. Therefore, tenth application, which is capable of revising the offset error correction value, can be applied. The concrete and practical threshold value ±αdeg/sec is obtained in each case by experimentation.

In the embodiment described in its aforementioned sixth and seventh applications, it is also appropriate to change the method of offset correction around the time of convergence. More precisely, it is appropriate to change frequency of revising the offset error correction value (revision cycle) before and after the convergence of the offset error correction value.

In this eleventh application, the sensitivity error is expressed as $Y^X\alpha/100$ (deg/sec), where the gyro sensitivity error is $\alpha$ percent, and yaw rate is Y (deg/sec). This value becomes bigger as the sensitivity error $\alpha$ gets bigger, whereas the offset error VO (deg/sec) does not have direct relation with the yaw rate as mentioned above. If the relation between the sensitivity error and the offset error is described as follows:

$$Y^X\alpha/100 << VO,$$

the eleventh application should operate properly. However, if it is not clear whether or not the above equation is satisfied, it is generally impossible to determine whether the error is caused by the offset error or the sensitivity error.

However, it is possible to vary the value of Y according to the degree of convergence of the sensitivity error as the sensitivity error can be determined by the degree of convergence in correction of sensitivity coefficient. As a result, it becomes possible to differentiate the cause of the error of gyro output between the offset error and the sensitivity error.

Figure 9:
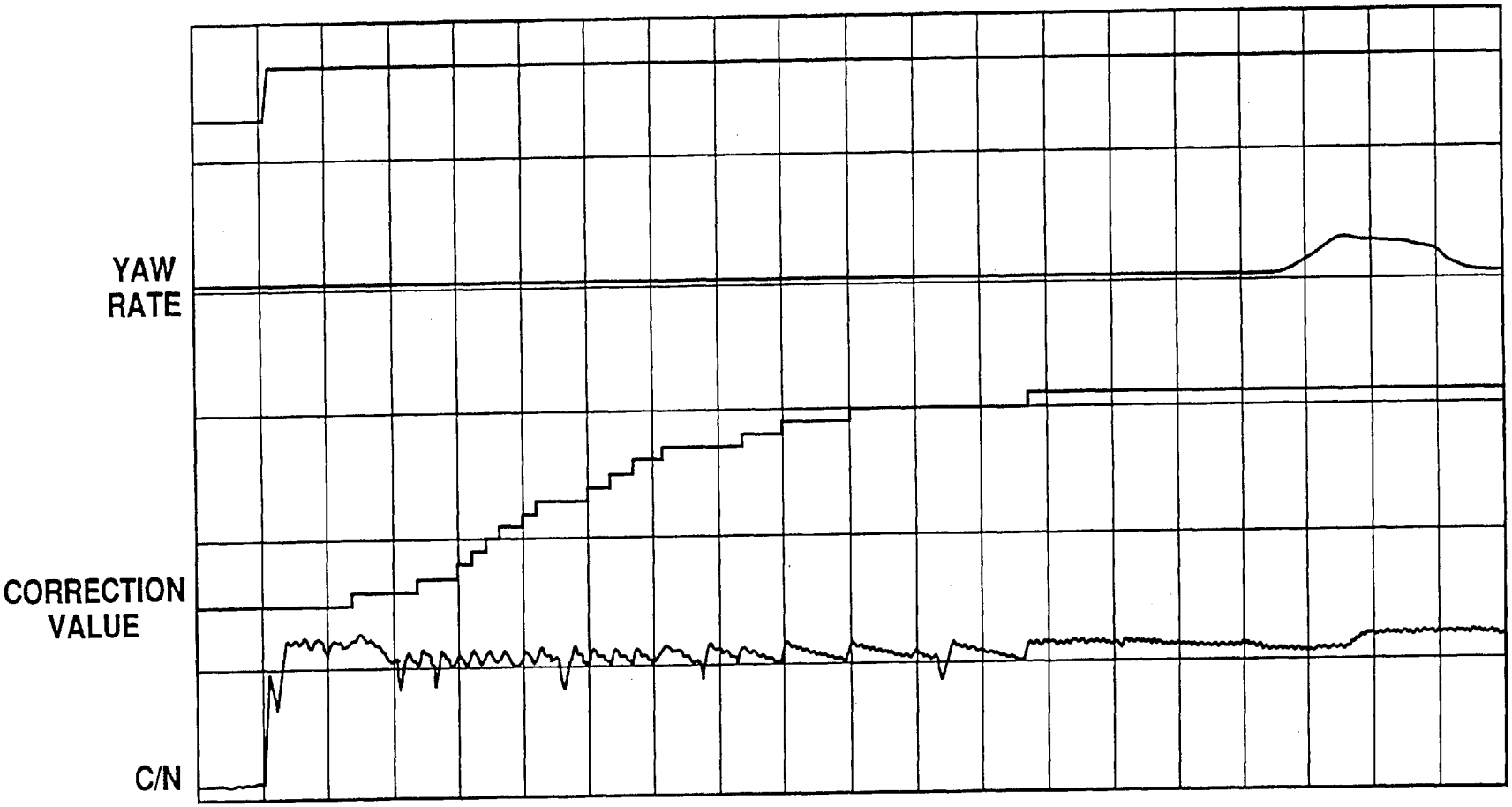
FIG. 9 is a graph showing a variation of the correction value of a vehicle mounted satellite signal receiving apparatus according to an embodiment of the present invention.
Figure 10:
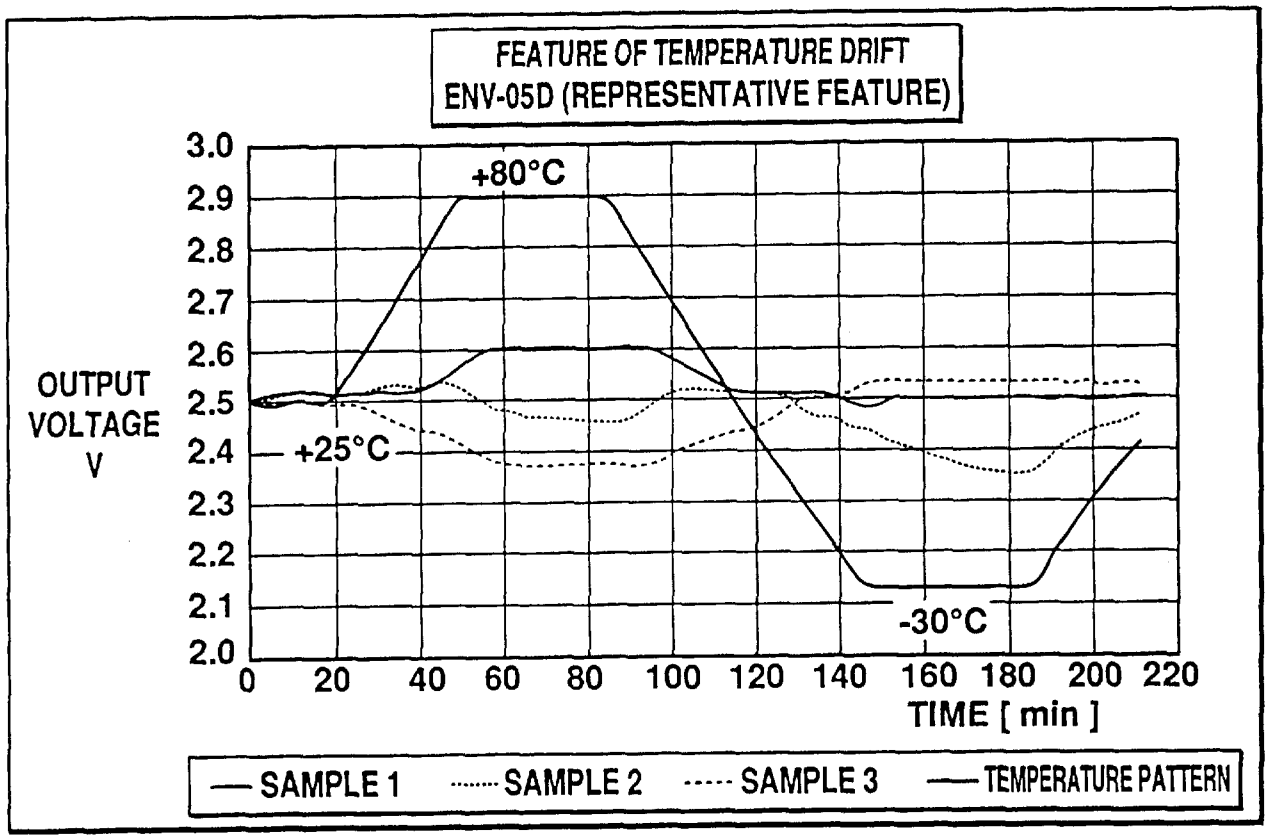
FIG. 10 is a graph showing temperature drifts of the gyro sensor.
Figure 11:
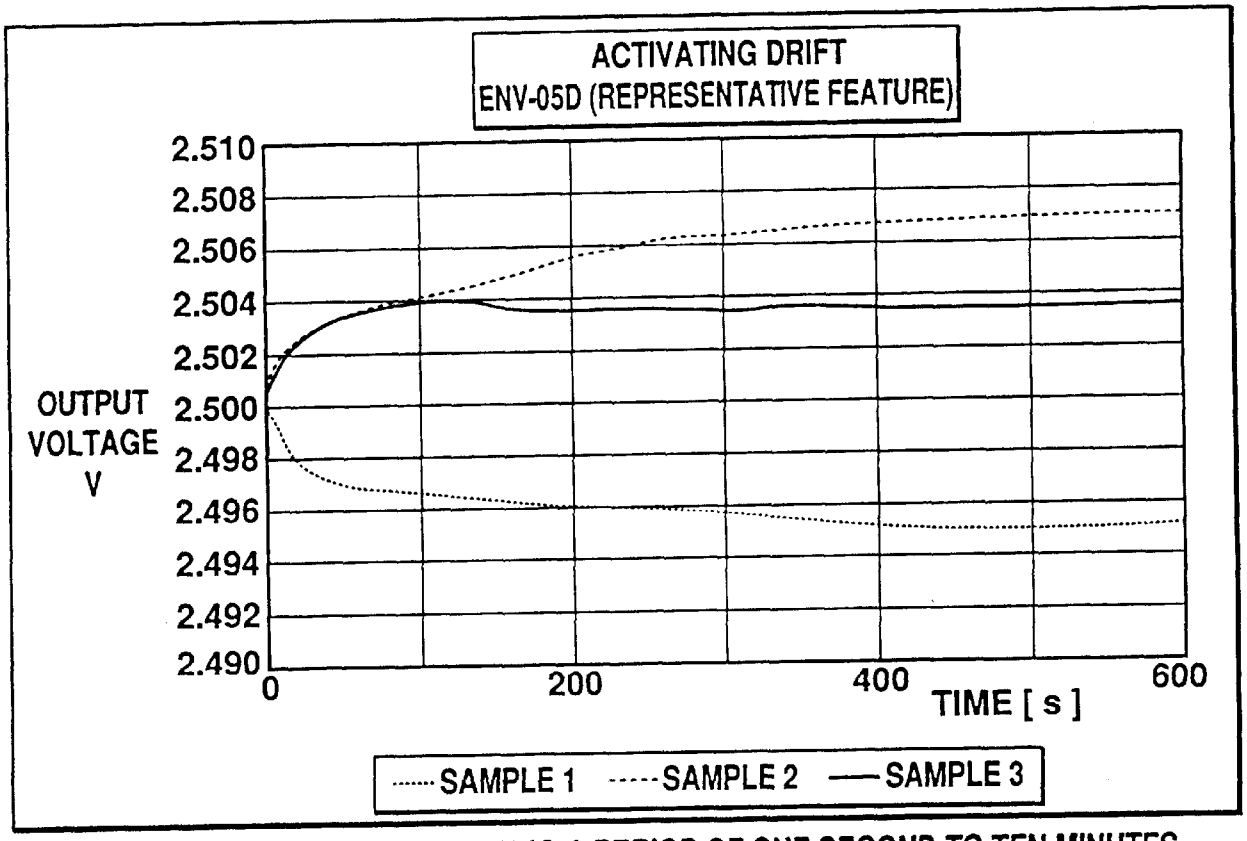
FIG. 11 is a graph showing time drifts of the gyro sensor.

FIG. 9 shows how the offset error correction value is revised according to this embodiment. The X axis represents time by 5 seconds per graduation. The Y axis represents each signal from the yaw rate, the offset error correction value, and the C/N (strength of reception level), respectively. As is shown in the graph of FIG. 9, the correction value is revised for 40 to 50 seconds after the power is supplied, and is convergent to a certain value after one minute or so. It is understood that with the progress of the convergence to the value, the C/N value for reception level is stabilized.

Japanese Patent Laid-Open Publication No. Hei 5-142321 discloses a concept that determines the direction of correction of the gyro sensor basing on the control direction of step tracking. The method introduced there is constituted in such a manner that H/L is changed over after detecting the variation of reception level, and it is necessary to perform sampling tests at a certain interval for detecting the variation of reception level. However, depending on the timing of sampling, the H/L changeover position (position which is deviated from the peak of a beam) differs.

The reception level always fluctuates. It is probable to have level reduction even if the antenna is rotated in the direction of level increase.

Furthermore, the reception level is reduced by the roll of vehicle or the like.

For these reasons, there is unevenness between periods "H" and "L," as shown in FIG. 4 of the aforementioned Official Gazette. Therefore, there is a problem that correction values are not necessarily convergent.

It is considered that the method given in the aforementioned Official Gazette, which adds an output $\alpha$ of a chopping wave generating circuit 27 and an output signal of an angular velocity sensor, cannot provide stable reception of satellite signals unlike the present invention because the output $\alpha$ is a signal which repeats increase and decrease in the form of chopping waves and therefore cannot be a true value, but fluctuates around the true value.

The cycle T of revising the offset error correction value gets longer as the difference between the offset error collection value and the true value of the error gets smaller because the shift from gyro tracking to hybrid tracking will become more difficult if the error is small. Therefore, the cycle T of revising the offset error correction value becomes shorter when the difference between the offset error correction value and the true value of the error is bigger, whereas the cycle T becomes longer when the difference between the offset error correction value and the true value of the error is smaller. This is a period required for transferring between level $L_B$ and level $L_C$ which are shown in FIG. 5. Thus, if the angular difference ($\Delta\phi$) equivalent to the difference between level $L_B$ and level $L_C$ is a constant value, the aforementioned period will be determined by a relative angular velocity of the BS antenna. The relative angular velocity of BS antenna corresponds to the offset error. Therefore, the aforementioned cycle T is a reference value (a value with a certain relation) to the offset error.

It is considered in this twelfth application to completely revise the offset error correction value at once by estimating the offset error basing on the cycle T. An extremely prompt revision of the offset error correction value is possible by inferring the offset error from the cycle T and revising the current offset error correction value so as to extinguish this error. By this process, the frequency of revision is lessened to once while 10 to 30 times (approximately 100×T seconds) repetition was needed until the offset error correction value was convergent.

The method of searching the offset error will be subsequently described.

As mentioned above, the relative angular velocity of BS antenna at the time the reception level declines from level $L_B$ to level $L_C$ is equal to the angular velocity $\omega_0$ of the difference between the true offset error and the offset error correction value. The relative angular velocity of BS antenna at the time the reception level is restored from level $L_C$ to level $L_B$ by hybrid tracking (or by step tracking) is a result of addition, namely $\omega_0+\omega S$, where step rate $\omega S$ is added to $\omega_0$, which is the angular velocity of the difference between the true offset error and the offset error correction value.

The following equation is obtained if the angular difference ($\Delta\phi$) equivalent to the difference between level $L_B$ and level $L_C$ is used.

$$t_1=\Delta\phi/\omega_0;\ t_2=\Delta\phi/(\omega_0+\omega S)$$

Here, $t_1$ represents a time period for the reception level to decline from level $L_B$ to level $L_C$ in the gyro tracking, and $t_2$ represents a time period for the reception level to restore from level $L_C$ to level $L_B$ in the hybrid tracking (or the step tracking).

The aforementioned cycle T is apparently equal to the summation of the aforementioned time periods $t_1$ and $t_2$. Therefore, $$\begin{aligned} T &= t_1 + t_2 \\ &= \Delta\phi\{1/\omega_0 + 1/(\omega 0 + \omega S)\} \end{aligned}$$

Here, supposing that $\omega S$ (step rate) is sufficiently larger than $\omega_0$, $1/\omega_0=1/(\omega_0+\omega S)$ becomes almost equal to $1/\omega_0$. Thus, the above equation is transformed as below.

$$T=\Delta\phi/\omega_0$$

Therefore, $\omega_0$, which is angular velocity of the difference between the true offset error and the offset error correction value, can be described as $\omega_0=\Delta\phi/T$. Thus the aforementioned angular velocity $\omega_0$ can be computed, basing on the time interval T for the revision of the offset error correction value and the angular difference $\Delta\phi$ equivalent to the difference between reception levels $L_B$ and $L_C$. It will be also possible to revise the offset error correction value at once if the offset error correction value $\Delta\omega G$ is revised only by the computed angular velocity $\omega_0$.

Figure 12:
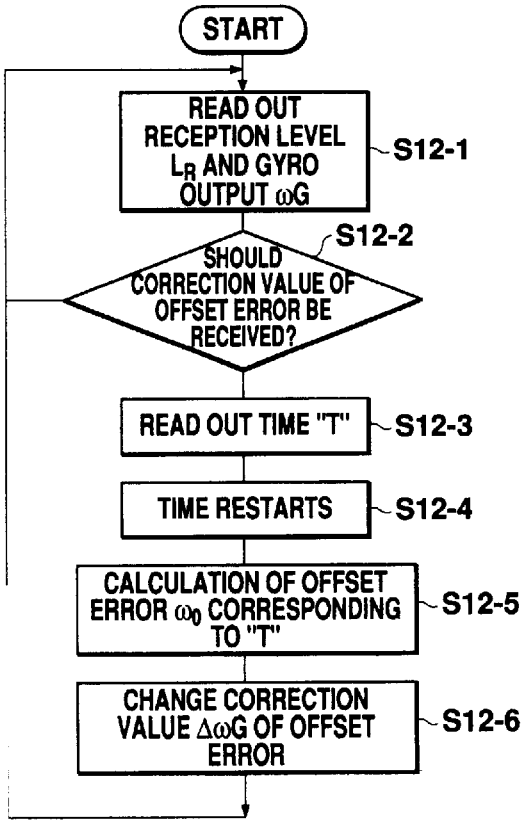
FIG. 12 is a flowchart showing operations in revision of an offset error correction value by adding to the correction value, a calculated difference between a true offset error and the correction value.
Figure 13A:
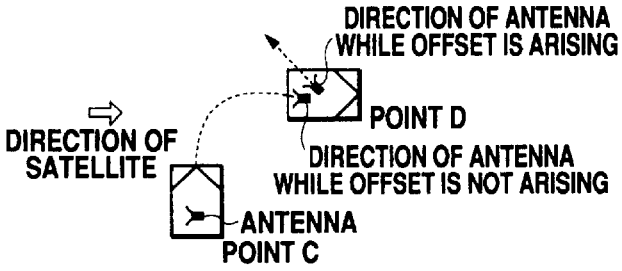
Fig. 13A PRIOR ART
FIG. 13 A is an explanatory drawing showing tracking operations of a conventional vehicle mounted satellite signal receiving apparatus.
Figure 13B:
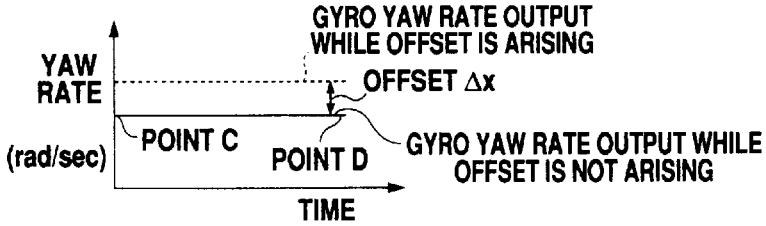
Fig. 13B PRIOR ART
Figure 13C:
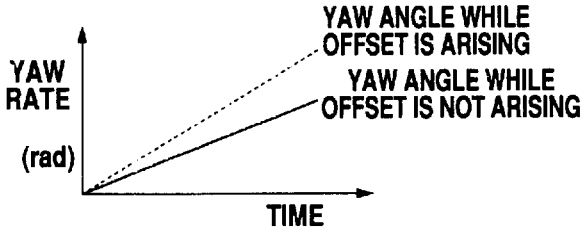
Fig. 13C PRIOR ART

Next, concrete operations of the twelfth application of the embodiment will be described by using a flowchart. In FIG. 12, which is a flowchart, concrete operations according to the twelfth application of the embodiment are shown.

First, at Step S12-1, the reception level $L_R$ and the gyro output signal $\omega G$ are read out.

Whether it is timing of revising the offset error correction value is determined at Step S12-2. If it is the timing of the revision, the processing program will advance to Step S12-3. However, if it is not the timing, the processing program will return to the aforementioned Step S12-1, where the reception level $L_R$ and the gyro output signal $\omega G$ are read out.

At Step S12-3, the time T is read out from a timer. This timer was restarted at the time of the previous revision of offset error correction value. The time T shows the elapsed period from the timing of the previous revision of offset error correction value.

At Step S12-4, the timer is reset and restarted. This is done for the purpose of utilizing the value of the timer at the time of the next revision of offset error correction value.

At Step S12-5, a true offset error $\omega_0$ is computed basing on the time T which was read out at the aforementioned Step S12-3. As mentioned above, the true offset error $\omega_0$ is computed by dividing the angular difference $\Delta\phi$, which is equivalent to the difference between the reception levels $L_B$ and $L_C$, by the time T. At the next Step S 12-6, the aforementioned $\omega_0$ is added to the correction value $\Delta\omega G$, which is used for correction of the offset error. 158

According to the example illustrated above, through these operations, a precise revision of the offset error is achieved at once, and a satellite signal receiving apparatus capable of maintaining prompt and satisfactory receiving conditions can be provided.

As mentioned above, according to the first aspect of the present invention, it is possible to provide a vehicle mounted satellite signal receiving apparatus, which is capable of making an efficient revision of the offset error correction value in order to cope with a drift of the offset error of the gyro sensor, whereby satisfactory receiving conditions can be maintained all the times.

According to the second aspect of the present invention, it is possible to provide a vehicle mounted satellite signal receiving apparatus which is capable of continuing a stable reception, even if the vehicle is temporarily interrupted by a tree or the like.

According to the third aspect of the present invention, it is possible to provide a vehicle mounted satellite signal receiving apparatus which has an ability not to make an erroneous revision of the offset error correction value against a drift of the offset error under the conditions of rolling or pitching.

According to the fourth aspect of the present invention, it is possible to provide a vehicle mounted satellite signal receiving apparatus which is capable of efficiently detecting only the decline of reception level caused by offset error and undertaking precise correction of offset error, based on the variation of receiving level signals.

According to the fifth and sixteenth aspects of the present invention, it is possible to provide a vehicle mounted satellite signal receiving apparatus which enables a prompt convergence and stable correction of offset error.

According to the sixth aspect of the present invention, it is possible to provide a vehicle mounted satellite signal receiving apparatus which enables a prompt convergence and stable correction of offset errors, as it can efficiently determine the period for the correction of initial offset error to complete.

According to the seventh aspect of the present invention, it is possible to provide a vehicle mounted satellite signal receiving apparatus which achieves the convergence more promptly and realizes satisfactory receiving conditions in a short span of time after the power is supplied.

According to the eighth aspect of the present invention, it is possible to provide a vehicle mounted satellite signal receiving apparatus which is capable of performing a stable reception though changes in the method of revising the offset error correction value before and after the convergence of the correction value.

According to the ninth aspect of the present invention, it is possible to provide a vehicle mounted satellite signal receiving apparatus which is capable of maintaining smooth and stable receiving conditions by revision using the summation of quantity of revision.

According to a tenth aspect of the present invention, it is possible to provide a vehicle mounted satellite signal receiving apparatus which enables stable correction of offset errors and realizes satisfactory receiving conditions by applying a threshold value to the summation of correction values and undertakes revisions only at an occasion that the summation is a certain value or more.

According to the eleventh aspect of the present invention, it is possible to provide a vehicle mounted satellite signal receiving apparatus which enables stable tracking and realizes satisfactory receiving conditions by varying quantity of tracking.

According to the twelfth aspect of the present invention, it is possible to provide a vehicle mounted satellite signal receiving apparatus which enables stable tracking and realizes satisfactory receiving conditions because it varies the interval of determination.

According to the thirteenth aspect of present invention, it is possible to provide a vehicle mounted satellite signal receiving apparatus which enables stable correction of offset errors without the influence of sensitivity errors and realizes satisfactory receiving conditions.

According to the fourteenth aspect of the present invention, it is possible to provide a vehicle mounted satellite signal receiving apparatus which is capable of promptly revising the correction value up to a normal value (true value) by inferring the degree of convergence of the offset error correction value on the basis of a cycle of the operation for revising the correction value.

According to the fifteenth aspect of the present invention, it is possible to provide a vehicle mounted satellite signal receiving apparatus which enables extremely prompt and precise correction of offset errors because due to realization of one time accurate revision of the offset error correction value.

While there has been described what are at present considered to be preferred embodiments of the invention and applications of these embodiments, it will be understood that various modifications maybe made thereto, and it is intended that the appended claims cover all such modifications as fall within the true spirit and scope of the invention.

What is claimed is:

1. A vehicle mounted satellite signal receiving apparatus comprising:

an antenna mounted on a vehicle;

a gyro sensor for detecting an angular velocity of azimuth rotation of said vehicle;

offset error correcting means for adding a correction value, which is used to correct an offset error of an output signal of said gyro sensor, to said output signal and for outputting a corrected output signal of said gyro sensor, which is derived from said correction of said offset error;

gyro tracking means for controlling direction of said antenna based on said corrected output signal of said gyro sensor when a reception level of a satellite signal is greater than or equal to a first predetermined value;

step tracking means for controlling a direction of said antenna so as to raise said reception level when said reception level is less than said first predetermined value; and revising means for revising said correction value by adding a revision value, which is in a same direction as a direction of control caused by said step tracking means, to said correction value when said reception level is less than said first predetermined value and said step tracking means commences controlling said direction of said antenna.

2. The vehicle mounted satellite signal receiving apparatus according to claim 1, wherein said revising means adds said revision value to said correction value only when a predetermined time period is less than or equal to a time period during which said reception level is equal to or greater than a second predetermined value.

3. The vehicle mounted satellite signal receiving apparatus according to claim 1, wherein said apparatus further comprises roll/pitch detecting means for detecting a roll or pitch of the vehicle, and wherein said revising means adds said revision value to said correction value only when said roll/pitch detecting means has not detected said roll or pitch of the vehicle.

4. The vehicle mounted satellite signal receiving apparatus according to claim 1 or 2, wherein said revising means adds said revision value to said correction value only when, at the time said reception level is less than said first predetermined value, a level declining velocity is less than or equal to a predetermined velocity.

5. The vehicle mounted satellite signal receiving apparatus according to claim 2 or 3, wherein said apparatus further comprises initial offset error correction incomplete state detecting means for detecting a state in which a drift has not been completely corrected after power has been supplied, and wherein said revising means adds said revision value to said correction value when said initial offset error correction incomplete state detecting means detects a state of incomplete correction of an offset error after supplying power, even though one of a predetermined time period is less than or equal to a time period during which said reception level is greater than or equal to said second predetermined value, said roll or pitch is detected, and when said reception level is less than said first predetermined value, said level declining velocity is greater than said predetermined velocity.

6. The vehicle mounted satellite signal receiving apparatus according to claim 5, wherein said initial offset error correction incomplete state detecting means determines, based on a rate of change of a satellite signal reception level, that said initial offset error has not been corrected if said rate of change is greater than or equal to a predetermined change value, and that said initial offset error has been corrected if said rate of change is less than said predetermined change value.

7. The vehicle mounted satellite signal receiving apparatus according to claim 1, wherein said revising means includes determining means for determining said revision value based on a degree of convergence of said correction value to a third predetermined value.

8. The vehicle mounted satellite signal receiving apparatus according to claim 1, wherein said revising means includes:

convergence detecting means for detecting whether convergence of said correction value has been achieved; and revision frequency changing means for changing a frequency at which said revising means adds said revision value said correction value, before and after said convergence detecting means detects said convergence of said correction value.

9. The vehicle mounted satellite signal receiving apparatus according to claim 7 or 8, wherein said revising means further includes:

accumulating means for accumulating said revision value and for retaining said accumulated revision value when said reception level is less than said first predetermined value and said step tracking means commences controlling said direction of said antenna; and adding means for adding said accumulated revision value to said correction value and for clearing said accumulated revision value retained by said accumulating means at predetermined intervals.

10. The vehicle mounted satellite signal receiving apparatus according to claim 7 or 8, wherein said revising means further includes:

accumulating means for accumulating said revision value and for retaining said accumulated revision value when said reception level is less than said first predetermined value and said step tracking means commences controlling said direction of said antenna; and adding means for checking said accumulated revision value at predetermined intervals, and, when said revision value is greater than a threshold value, for adding said accumulated revision value to said correction value and clearing said accumulated revision value retained by said accumulating means.

11. The vehicle mounted satellite signal receiving apparatus according to claim 1, wherein said revising means includes convergence detecting means for detecting whether convergence of said correction value has been achieved, and said step tracking means includes control interval setting means for setting a control interval, which is an interval of sampling said satellite signal, to different values before and after said convergence of said correction value has been detected by said convergence detecting means.

12. The vehicle mounted satellite signal receiving apparatus according to claim 1, wherein said revising means includes convergence detecting means for detecting whether convergence of said correction value has been achieved, and said step tracking means includes angular velocity setting means for setting an angular velocity of rotation of said antenna to different values before and after said convergence detecting means detects said convergence of said correction value.

13. The vehicle mounted satellite signal receiving apparatus according to claim 1, wherein said revising means revises said correction value only when said angular velocity of azimuth rotation of said vehicle is less than a fourth predetermined value.

14. The vehicle mounted satellite signal receiving apparatus according to claim 7, wherein said determining means includes means for setting said revision value based on a revision cycle operation performed by said revising means.

15. The vehicle mounted satellite signal receiving apparatus according to claim 1, wherein said apparatus further comprises:

revision cycle measuring means for measuring a revision cycle, which is a time interval for revising said correction value;

offset error calculating means for calculating said offset error based on revision cycle; and second revising means for revising said correction value to a true correction value of said gyro sensor by adding said offset error calculated by said offset error calculating means to said correction value.

16. The vehicle mounted satellite signal receiving apparatus according to claim 4, wherein said apparatus further comprises:

initial offset error correction incomplete state detecting means for detecting a state in which correction of a drift has not been completed after power has been supplied, wherein said revising means adds said revision value to said correction value, as long as said initial offset error correction incomplete state detecting means detects a state of incomplete correction of said offset error after supplying power, even though one of a predetermined time period is less than or equal to a time period during which said reception level is equal to or greater than said second predetermined value, said roll or pitch is detected, and said level declining velocity is greater than a predetermined velocity when said reception level is less than said first predetermined value.

* * * * *